US006945520B2

(12) United States Patent
Ohgane et al.

(10) Patent No.: US 6,945,520 B2
(45) Date of Patent: Sep. 20, 2005

(54) STARTING ASSEMBLY FOR A CARBURETOR

(75) Inventors: Shinichi Ohgane, Miyagi-ken (JP); Takashi Horikawa, Miyagi-ken (JP); Katsushi Habu, Miyagi-ken (JP); Takeshi Sakaguchi, Miyagi-ken (JP); Hiraku Watanabe, Miyagi-ken (JP); Hiroaki Ishii, Miyagi-ken (JP)

(73) Assignee: Walbro Japan, Inc., Tokyo (JP)

( * ) Notice: Subject to any disclaimer, the term of this patent is extended or adjusted under 35 U.S.C. 154(b) by 55 days.

(21) Appl. No.: 10/866,918

(22) Filed: Jun. 14, 2004

(65) Prior Publication Data

US 2005/0017379 A1 Jan. 27, 2005

Related U.S. Application Data

(62) Division of application No. 10/310,228, filed on Dec. 5, 2002, now Pat. No. 6,769,670.

(30) Foreign Application Priority Data

Dec. 7, 2001 (JP) ..... 2001-374117
Dec. 7, 2001 (JP) ..... 2001-374118
Dec. 7, 2001 (JP) ..... 2001-374119

(51) Int. Cl.[7] ..... F02M 9/08
(52) U.S. Cl. ..... 261/44.6; 261/44.8
(58) Field of Search ..... 261/44.6, 44.8, 261/35, 69.1, DIG. 68

(56) References Cited

U.S. PATENT DOCUMENTS 1,120,845 A * 12/1914 Parkin ..... 261/44.8
1,231,773 A * 9/1917 Miller et al. ..... 261/41.3
2,691,509 A * 10/1954 Rivoche ..... 261/36.2
5,599,484 A * 2/1997 Tobinai ..... 261/44.2
5,709,822 A * 1/1998 Togashi ..... 261/44.2
5,942,160 A * 8/1999 Araki ..... 261/44.8
6,202,988 B1 * 3/2001 Abe et al. ..... 261/34.1
6,378,846 B1 * 4/2002 Terakado et al. ..... 261/44.8
6,394,424 B2 * 5/2002 Pattullo et al. ..... 261/35
6,394,425 B1 * 5/2002 Nagata ..... 261/44.8
6,585,235 B2 * 7/2003 Pattullo ..... 261/44.8
6,672,570 B2 * 1/2004 Takano et al. ..... 261/39.2
6,769,670 B2 * 8/2004 Ohgane et al. ..... 261/44.6

FOREIGN PATENT DOCUMENTS

JP 63-88257 * 4/1988 ..... 261/44.6
JP 1-294947 * 11/1989 ..... 261/44.8

OTHER PUBLICATIONS

* References Were Cited In Applicants) Parent Case U.S. Appl. No. 10/310,228.*

* cited by examiner

*Primary Examiner*—Richard L. Chiesa
(74) *Attorney, Agent, or Firm*—Reising, Ethington, Barnes, Kisselle, P.C.

(57) ABSTRACT

A starting device for a rotary throttle valve-type carburetor enables adjustment of the quantity of air and fuel delivered to an engine to facilitate the cold start of the engine. The starting device changes the position of the throttle valve prior to starting the engine to adjust the fuel and air mixture delivered to the engine as desired to facilitate starting and initial warming up of the engine.

12 Claims, 13 Drawing Sheets

STARTING ASSEMBLY FOR A CARBURETOR

REFERENCE TO RELATED APPLICATION

This application is a division of application Ser. No. 10/310,228, filed Dec. 5, 2002 now U.S. Pat. No. 6,769,670.

Applicants claim priority of Japanese patent applications, Ser. No. 2001-374,117, filed Dec. 7, 2001, Ser. No. 2001-374,118, filed Dec. 7, 2001 and Ser. No. 2001-374,119, filed Dec. 7, 2001.

FIELD OF THE INVENTION

The present invention relates to a rotary throttle valve carburetor for an internal combustion engine, and more particularly to such a carburetor having a starting device.

BACKGROUND OF THE INVENTION

The conventional rotary throttle valve-type carburetor is designed so that turning of the throttle valve causes a needle to be moved up and down to adjust the extent to which a fuel nozzle is open. In low temperatures when the engine is cold, frictional resistance in the engine is high. Therefore, the engine is hard to start, and even if the engine is started its idle operation is unstable.

As shown in FIG. 51, a conventional rotary throttle valve-type carburetor has a carburetor body 5 provided with a cylindrical valve chamber 6 perpendicular to an air intake passage (extending vertically relative to the paper surface) a throttle valve 1 having a throttle hole 2 is rotatably and vertically movably fitted in the valve chamber 6. A valve shaft 1*a* of the throttle valve 1 extends through a lid plate 21 for closing the valve chamber 6, and a throttle valve lever 22 is connected to the upper end of the valve shaft 1*a*. A swivel 23 for connecting a remote control cable is rotatably supported on one end of the throttle valve lever 22, whereas a cam portion 22*a* is provided on the other end of the throttle valve lever 22. A peripheral cam groove with a depth that becomes gradually shallower in a direction of rotation corresponding to an increased throttle valve opening is provided in the lower surface of the cam portion 22*a* and a follower supported on the lid plate 21 is engaged with the cam groove to thereby constitute a cam mechanism.

Fuel is taken into a fuel nozzle of a fuel supply pipe 4 projecting toward the throttle hole 2 via a check valve and a fuel jet. In FIG. 51, the throttle valve 1 is in a fully open position, and the throttle hole 2 and the air intake passage are substantially registered or coincident in an axial direction. A needle 3 projecting downward from the throttle valve 1 is inserted into the fuel supply pipe 4.

In operation, to increase the speed and/or power of the engine, the throttle valve lever 22 is turned or rotated in an accelerating direction against the force of a spring to increase the extent to which the throttle hole 2 is open relative to the air intake passage. At the same time, the needle 3 is moved up by the aforementioned cam mechanism to increase the extent to which the fuel nozzle is open.

A start shaft 32 is fitted into a guide tube 53 formed integral with the lid plate 21, and when the start shaft 32 is turned by means of a start lever 31, a cam surface 52 formed on the end portion of the start shaft 32 lifts up the throttle lever 22 so as to increase the quantity of fuel. A pin 51 on the guide tube 53 is engaged with an annular groove of the start shaft 32 to retain the start shaft 32 in the guide tube 53.

In a small engine for a work tool provided with a centrifugal clutch and the aforementioned rotary throttle valve-type carburetor, when the airflow through the carburetor is increased sufficiently over the calibrated air flow for idle engine operation (thereby increasing the engine rpm at idle), the centrifugal clutch can become connected so that a tool driven by the engine is actuated, which may be undesirable. Accordingly, the airflow when the engine is started has to be set so that the speed (rpm) of the engine is slightly faster than the calibrated idle setting, but not so high as to engage the clutch.

However, after the break-in period of the engine, the set idle speed becomes faster than the value set after assembly at the factory. At this time, when the idling speed is adjusted to a proper value the increase in airflow at the start of the engine as adjusted by the start fuel increasing mechanism, can place the speed of the engine out of its desired range.

SUMMARY OF THE INVENTION

A starting device for a rotary throttle valve-type carburetor enables adjustment of the quantity of air and fuel delivered to an engine to facilitate the cold start of the engine. In one embodiment, the starting device has an axially slidable sleeve fitted into a guide tube supported on a lid plate for closing a valve chamber of a carburetor body. A pin extending through the sleeve is engaged with an axial slit of the guide tube. A first projecting part extends outwardly from the guide tube and a second projecting part extends outwardly from the sleeve, and an idling adjusting bolt extends through the second projecting part and is threadedly fitted in the first projecting part. A start shaft having a helical groove in engagement with the pin is fitted into the sleeve, and has an actuator comprising at least in part a flat cam surface for engagement with a cam plate provided on a valve shaft of a throttle valve. A push rod for engagement with a side wall surface provided on the valve shaft is formed on the end of the start shaft. When the start shaft is rotated, the cam surface engages and lifts the throttle valve to increase fuel flow, and the push rod rotates the throttle valve to further open it and increase the air flow. By adjusting the position of the cam surface and the push rod relative to the throttle valve, the extent of the increase in fuel flow and air flow can be adjusted to provide a desired fuel and air mixture to facilitate starting the engine.

In another embodiment, a start shaft is threaded in a boss portion formed on the lid plate. A cam surface is formed on the end portion of the start shaft, a push rod is threaded in the start shaft, and a protrusion is formed on the lower surface of a throttle valve lever connected to a valve shaft of the throttle valve. When the start shaft is rotated, a throttle valve lever is lifted up by the cam surface, and the protrusion on the throttle valve lever is pushed by the axial movement of said start shaft and push rod to turn or rotate the throttle valve lever.

In another embodiment, the actuator comprises an eccentric push rod with a cam surface to both lift and rotate the throttle valve lever. Several other embodiments of carburetors with starting assemblies are disclosed herein.

BRIEF DESCRIPTION OF THE DRAWINGS

These and other objects, features and advantages will be apparent from the following detailed description of the preferred embodiments, appended claims and accompanying drawings in which:

DETAILED DESCRIPTION OF THE PREFERRED EMBODIMENTS

Figure 1:
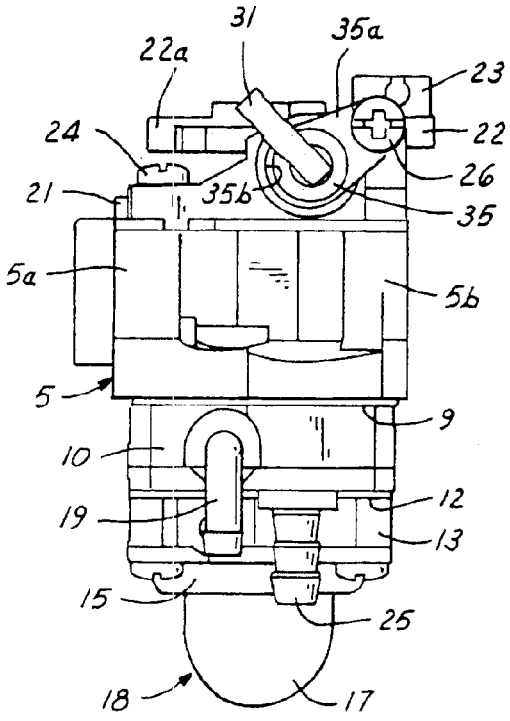
FIG. 1 is a side view of a rotary throttle valve-type carburetor provided with a starting device according to a first embodiment of the present invention.
Figure 2:
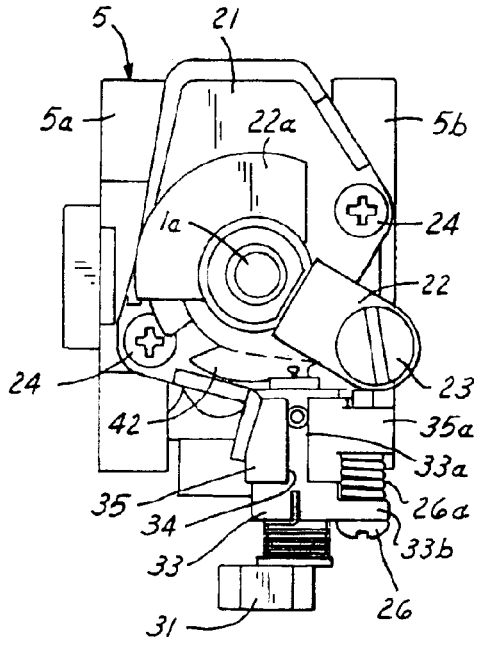
FIG. 2 is a plan view of the rotary throttle valve-type carburetor.

As shown in FIGS. 1 and 2, in the rotary throttle valve-type carburetor an air cleaner and a heat insulating pipe are butted on the front and rear end flanges 5*a* and 5*b* of a carburetor body 5 through which an air intake passage extends longitudinally. The body 5 is connected to the engine by a pair of mounting bolts. An intermediate plate 10 defining in part a fuel pump is connected to the lower surface of the carburetor body 5 through a fuel pump diaphragm 9. Another intermediate plate 13 defining in part a fuel metering chamber is connected to the lower surface of the intermediate plate 10 through a fuel metering diaphragm 12. A primer and purge assembly 18 has a bulb 17 connected to the lower surface of the intermediate plate 13 by means of a keep plate 15. Fuel in a fuel tank is supplied to the fuel metering chamber via a fuel inlet pipe 25 and a fuel pump. When the primer and purge assembly 18 is operated by depressing the bulb 17 repeatedly, fuel vapor or the like in the fuel metering chamber is returned to the fuel tank via a return pipe 19 and liquid fuel is drawn into fuel passages and chambers in the carburetor.

Figure 51:
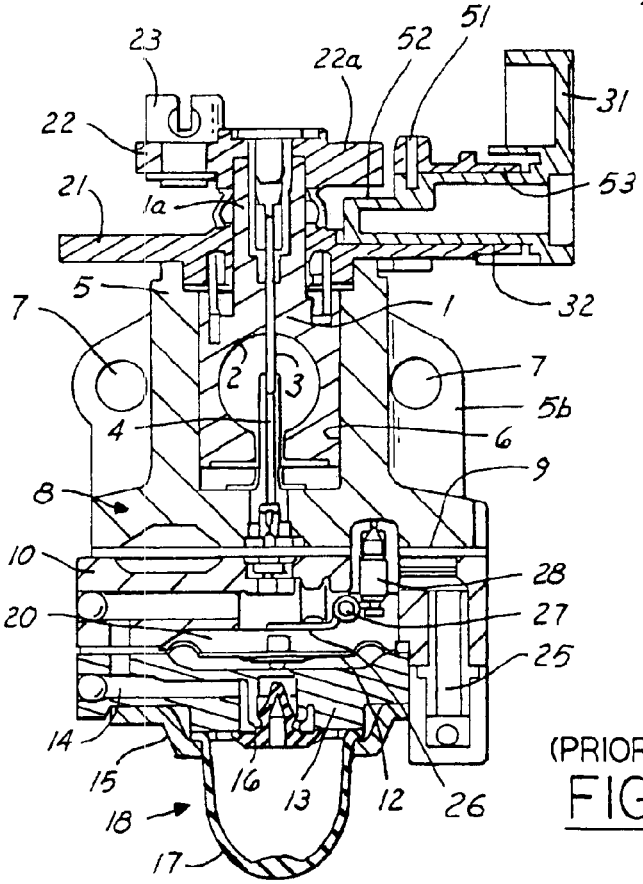
(PRIOR ART) FIG.51
FIG. 51 is a front sectional view of a conventional rotary throttle valve-type carburetor according to the prior art.

The fuel pump may be of generally conventional construction, such as that shown in the prior art carburetor of FIG. 51. When pulsating pressure of a crankcase chamber of the engine is introduced into a chamber defined by the fuel pump diaphragm 9, the diaphragm 9 is displaced so that fuel in a fuel tank, not shown, is taken into a lower chamber or a pump chamber defined by the diaphragm 9 via the fuel inlet pipe 25, a filter and a pump inlet valve, and is further discharged into a fuel metering chamber 20 on the upper side of the diaphragm 12 through a pump outlet valve and an inlet valve 28 of a fuel metering assembly.

The fuel metering assembly may also be of generally conventional construction as shown in FIG. 51. This assembly has a lever 26 supported in the fuel metering chamber 20 by means of a shaft 27, one end of the lever is biased and engaged with a center protrusion of the diaphragm 12 by the force of a spring, and the other end of the lever is engaged with the lower end of the inlet valve 28. Fuel enters the fuel metering chamber 20 through the inlet valve 28 which opens and closes in response to displacement of the diaphragm 12. The chamber on the side of the diaphragm 12 opposite the fuel metering chamber 20 is open to the atmosphere. Fuel in the fuel metering chamber 20 is taken into the fuel supply pipe 4 which has an opening or nozzle projecting toward the throttle hole 2 via a check valve and a fuel jet.

Returning to FIGS. 1 and 2, a lid plate 21 is put on the upper surface of the carburetor body 5 and secured by means of bolts 24. A throttle valve lever 22 having an arcuate cam portion 22*a* is connected to the upper end of a valve shaft 1*a* of the throttle valve projected upward through the lid plate 21. A swivel 23 for connecting a remote-control cable is supported on the throttle valve lever 22, and the throttle valve lever 22 is normally brought into contact with an idling adjusting bolt 26 by the force of a return spring (not shown).

An axial slit 34 is provided on the upper wall of a guide tube 35 which is connected to the lid plate 21 or formed integrally with the lid plate 21, and a tapped hole for threadedly receiving the idling adjusting bolt 26 is provided in a projection 35*a* extending outwardly from the guide tube 35. A sleeve 33 is fitted into the guide tube 35, and a pin 33*a* extending through the peripheral wall of the sleeve 33 is engaged with a shoulder defined by the slit 34. The idling adjusting bolt 26 extends through a flange 33*b* of the sleeve 33 and a spring 26*a* and is threadedly engaged with the projection 35*a*. The throttle valve lever 22 is brought into contact with the end of the idling adjusting bolt 26 by the force of a return spring to control an idling position of the throttle valve lever 22.

Figure 3:
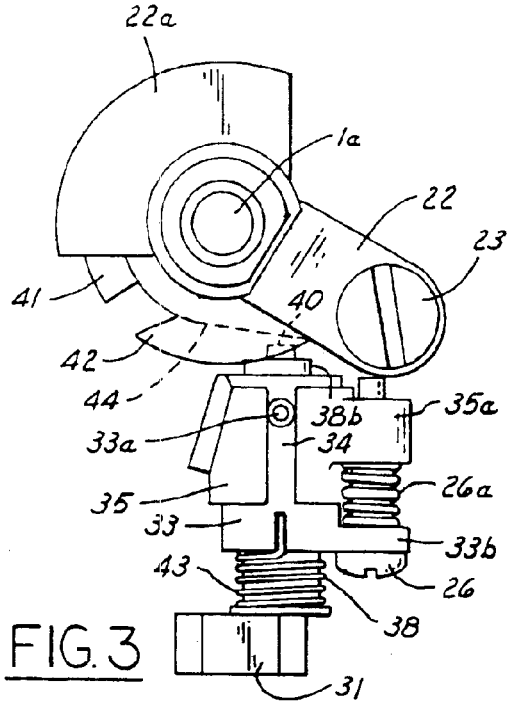
FIG. 3 is a plan view showing, in an enlarged scale, a portion of the rotary throttle valve-type carburetor.
Figure 4:
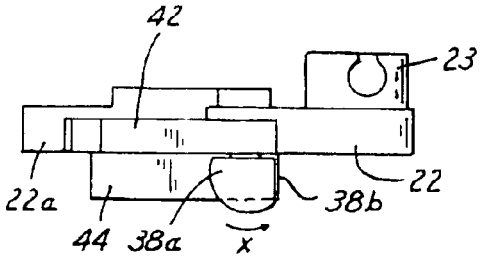
FIG. 4 is a front view showing a throttle valve lever and a cam of the rotary throttle valve-type carburetor.
Figure 5:
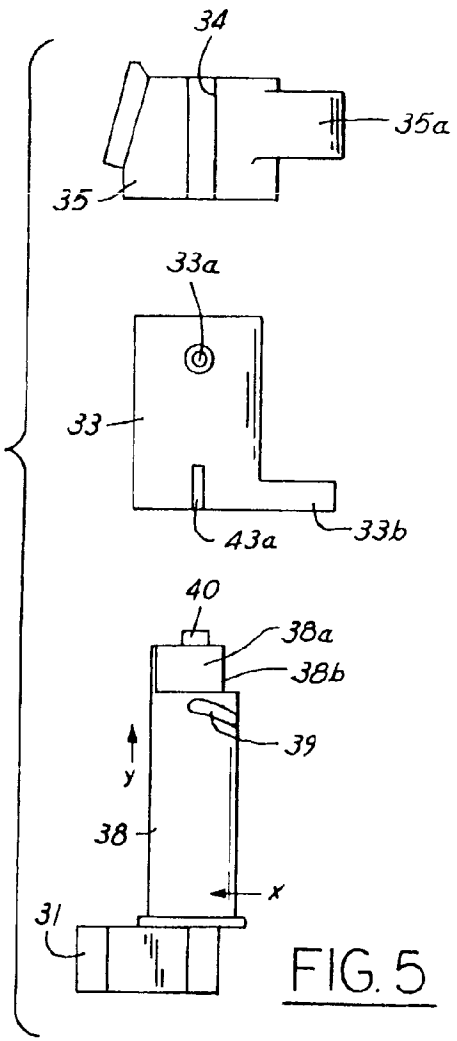
FIG. 5 is an exploded plan view showing portions of the starting device of the rotary throttle valve-type carburetor.

As shown in FIGS. 3–5, a start shaft 38 provided with a start lever 31 is fitted into the sleeve 33. An actuator is associated with the start shaft, and as shown here, comprises a cam 38*a* having a flat cam surface 38*b* provided on an end portion of the start shaft 38, and a push rod 40 provided on the shaft center of the end of the start shaft 38. Further, the start shaft 38 is provided with a helical groove 39 (FIG. 5) in engagement with the pin 33*a* projecting into the sleeve 33.

As mentioned above, the sleeve 33 is fitted into the immovable guide tube 35, and the start shaft 38 is fitted into the sleeve 33 so that the helical groove 39 engages the pin 33*a* of the sleeve 33. One end of a spring 43 wound about the distal end of the start shaft 38 is engaged at a groove 43*a* (FIG. 5) of the sleeve 33, while the other end of the spring 43 is stopped on the start lever 31. The start lever 31 is normally biased to a first position by the force of the spring 43. In this position, as shown in FIG. 4, a clearance is formed between the cam 38*a* and the lower surface of the throttle valve lever 22. As shown in FIG. 3, a cam plate 42 is provided on the valve shaft 1*a* of the throttle valve 1, especially between the throttle valve lever 22 and the cam portion 22*a*, and a flat side wall surface 44 is provided below the cam plate 42.

When the start lever 31 is turned to its second position to prepare for a cold start of the engine, the flat cam surface 38*b* engages the lower surface of the cam plate 42 to lift up the throttle valve lever 22. Correspondingly, this movement of the throttle valve increases the extent to which the fuel nozzle is open or stated differently, the flow area of the nozzle is increased. This enables a richer than normal fuel and air mixture to be delivered to the engine to facilitate starting it.

Simultaneously, the start shaft 38 is moved in an axial direction (in the direction of the arrow y in FIG. 5) by the engagement between the helical groove 39 of the start shaft 38 and the pin 33*a*. The axial movement of the start shaft 38 causes the push rod 40 to engage and displace the side wall surface 44 of the valve shaft 1*a* which rotates the throttle valve lever 22. This in turn increases the effective flow area through the throttle hole of the throttle valve. In this manner, upward movement and rotation of the throttle valve 1 are achieved by the rotation of the start lever 31, so the quantity of fuel and air delivered to the engine increases to obtain smooth starting and initial idle operation of the engine.

After warming up the engine, the throttle valve lever 22 is turned to further open the throttle valve, and the throttle valve lever 22 is lifted up by the normal cam mechanism and moved away from the cam surface 38*b*. Therefore, the start shaft 38 having the cam 38*a* is returned to its first position by the force of the spring 43 preventing further interaction with the throttle valve to permit normal carburetor operation.

As just described, the cam surface 38*b* and the push rod 40 are provided on the start shaft 38 which is turned by the start lever 31. The cam surface 38*b* can be engaged with the cam plate 42 formed integral with the valve shaft 1*a* and the push rod 40 can be engaged with the side wall surface 44 formed integral with the valve shaft 1*a*. Therefore, the distance and location from the start shaft center of the cam surface 38*b* and the axial dimension or effective length of the push rod 40 are adapted to the desired starting characteristics of the engine to thereby provide a desired fuel and air mixture to the engine to facilitate starting and warming up the engine. Since the fuel quantity and the air quantity can be adjusted separately, machining is easily accomplished.

In case the engine idle speed is adjusted according to the operating hysteresis or operating environment of the engine by, for example, retracting the idling adjusting bolt 26, the throttle valve lever 22 is positioned at idle further away from its wide open position to reduce the air flow at idle. The sleeve 33 and the start shaft 38 are moved back in the axial direction at the same time, and therefore, the relative spacing between the push rod 40 of the start shaft 38 and the side wall surface 44 of the valve shaft 1*a* remains unchanged. The increased quantity of fuel and air when the start lever 31 is rotated to its second position before the cold start of the engine is almost the same as the case prior to the adjustment of the idle position of the throttle valve. Since the airflow at idle is reduced by retracting the idling adjusting bolt 26, the air/fuel ratio becomes more rich since the increased fuel flow can remain essentially the same as before adjustment of the idling adjustment bolt 26.

Second Embodiment

Figure 6:
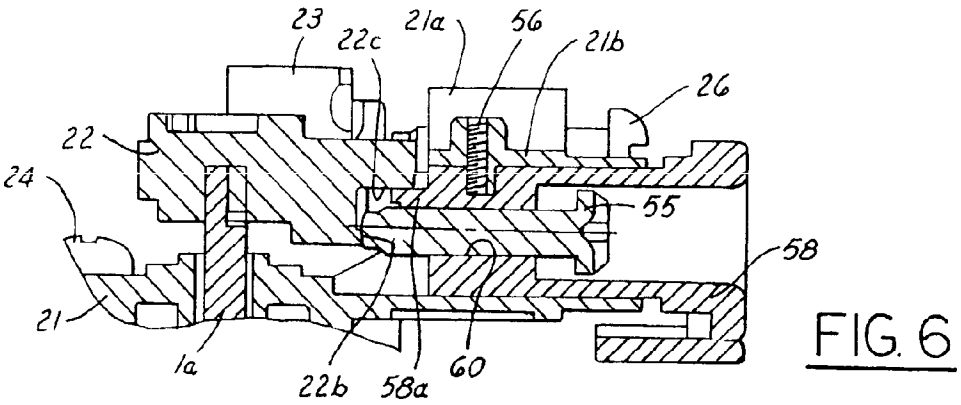
FIG. 6 is a fragmentary front sectional view of a rotary throttle valve-type carburetor provided with a starting device according to a second embodiment of the present invention.
Figure 7:
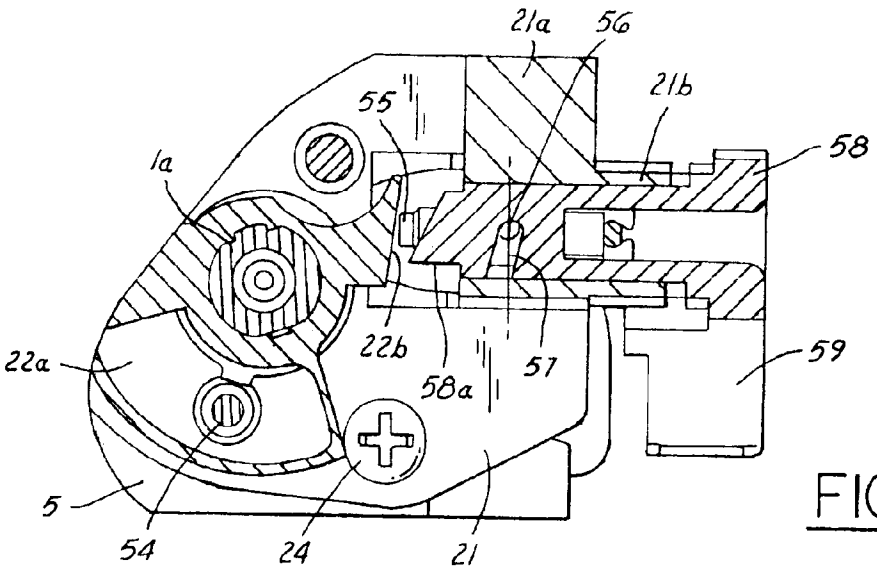
FIG. 7 is a partial plan sectional view of the rotary throttle valve-type carburetor of FIG. 6.
Figure 8:
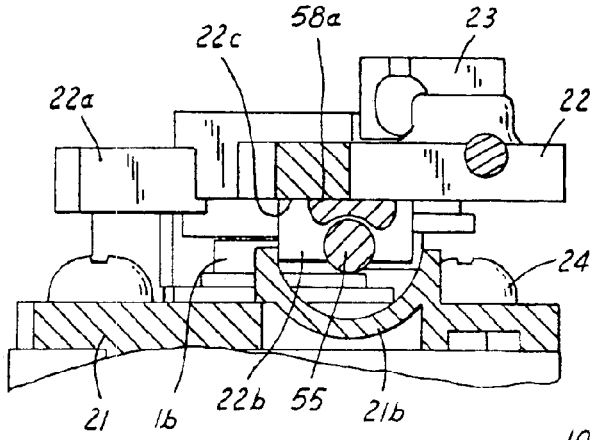
FIG. 8 is a fragmentary side sectional view of the rotary throttle valve-type carburetor of FIG. 6.

In the embodiment shown in FIGS. 6 to 8, the lid plate 21 for closing the valve chamber is fixed on the carburetor body 5 by a plurality of bolts 24, and the throttle valve lever 22 is connected to the upper end of the valve shaft 1*a* extending through the lid plate 21. As shown in FIG. 8, the valve shaft 1*a* is covered with a dust-proof boot 1*b*. The swivel 23 is supported on the end of the throttle valve lever 22, a cam portion 22*a* is formed integral with the other end thereof. A cam groove in engagement with a follower 54 projecting from the lid plate 21 is provided in the cam portion 22*a*, as shown in FIGS. 6 and 7. A projecting wall 22*b* is projected downward from the lower surface 22*c* of the throttle valve lever 22. The idling adjusting bolt 26 is threadedly fitted in a projecting wall 21*a* which is projected upward from a side edge of the lid plate 21. A boss portion or a guide tube 21*b* is formed integral with the lid plate 21, especially adjacent to the projecting wall 21*a*, and a start shaft 58 having a start lever 59 and an actuator associated therewith is rotatably fitted into the guide tube 21*b*. A helical or arcuate groove 57 is formed in the outer peripheral surface of the start shaft 58, and a guide pin 56 in engagement with the helical groove 57 is secured to the guide tube 21*b*. The actuator comprises, at least in part, the push rod 55 and a cam surface 58*a*. The push rod 55 is threadedly fitted in a tapped hole 60 provided in the shaft center of the start shaft 58, and the extreme end of the push rod 55 can be placed in contact with the projecting wall 22*b*. The flat cam surface 58*a* is formed on the end portion of the start shaft 58 to be engagable with the lower surface 22*c* of the throttle valve lever 22.

The start lever 59 is normally in a first position wherein the cam surface 58*a* is moved away from the lower surface 22*c* of the throttle valve lever 22, and the push rod 55 is close to the projecting wall 22*b* but is not in contact therewith. When the start lever 59 is rotated toward its second position in preparation for starting a cold engine, the start shaft 58 is moved generally axially as while guided by the engagement of the guide pin 56 and groove 57. At this time, as shown in FIGS. 6 and 8, the cam surface 58*a* comes in contact with the lower surface 22*c* of the throttle valve lever 22 to lift up the throttle valve lever 22. At the same time, the push rod 55 impinges on the projecting wall 22*b* (as shown in FIGS. 6 and 7) to rotate the throttle valve lever 22 toward its wide open position.

As described above, when the throttle valve lever 22 is moved up by the cam surface 58*a*, the extent to which the fuel nozzle of the fuel supply pipe is open increases to increase the quantity of fuel delivered to the engine. At the same time, when the throttle valve lever 22 is rotated by the push rod 55, the extent to which the throttle hole of the throttle valve is open increases to increase the quantity of air. The amount that the throttle valve lever 22 is lifted is determined by the distance from the center of the start shaft 58 to the cam surface 58*a*. The amount the throttle valve lever 22 is rotated can be adjusted by advancing or retracting the push rod 55 in the tapped hole 60 of the start shaft 58. Accordingly, both the fuel flow and the air flow at the cold start of the engine can be adjusted independently to provide improved starting and more stable idle engine operation after starting the engine. It is also possible to avoid increasing the engine idling speed which may be desirable to avoid engagement of a centrifugal clutch if one is used with the engine.

Third Embodiment

Figure 10:
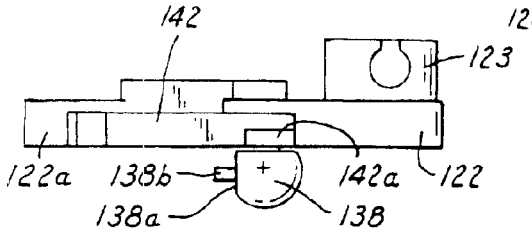
FIG. 10 is a front view showing portions of the starting device of the rotary throttle valve-type carburetor of FIG. 9.
Figure 9:
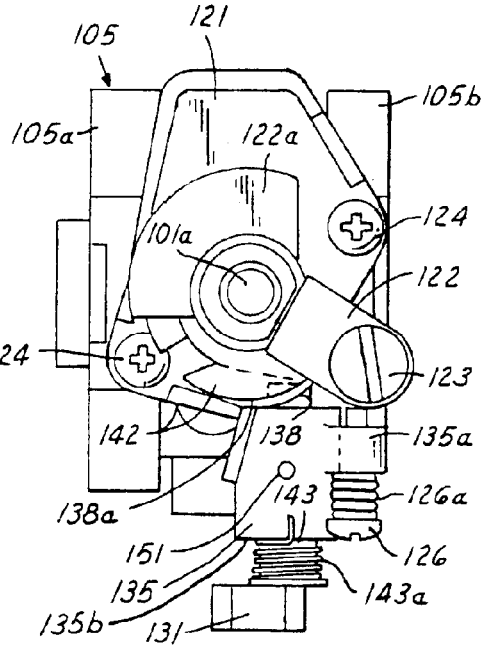
FIG. 9 is a plan view of a rotary throttle valve-type carburetor provided with a starting device according to a third embodiment of the present invention.

In the embodiment shown in FIGS. 9 and 10, a lid plate 121 is put on the upper surface of the carburetor body 105 and secured thereto by means of bolts 124. A throttle valve lever 122 having a quadrant-shaped cam 122*a* is connected to the upper end of a valve shaft 101*a* of a throttle valve, the valve shaft 101*a* extending upwardly through the lid plate 121. The throttle valve lever 122 is normally placed in contact with an idling adjusting bolt 126 by the force of a return spring, not shown. The throttle valve lever 122 is provided with a cam plate 142 and an outwardly extending projection 142*a* is formed on the outer edge of the cam plate 142.

A start shaft 143 is fitted into an axial hole 135*b* of a guide tube 135 which is connected to the lid plate 121 or formed integral with the lid plate 121. A pin 151 mounted on the guide tube 135 is engaged with an annular groove formed on the start shaft 143. An idling adjusting bolt 126 having a locking spring 126*a* wound thereabout is threadedly fitted through a flange 135*a* projected outwardly from the guide tube 135.

An actuator associated with the start shaft 143 comprises, at least in part, a push rod 138*b* and a cam 138. The cam 138 is formed on the end portion of the start shaft 143 and a flat cam surface 138*a* is formed on the outer peripheral surface of the cam 138. The push rod 138*b* extends outwardly from the cam surface 138*a*.

One end of a spring 143*a* wound about the distal end portion of the start shaft 143 is fastened on the guide tube 135 and the other end of the spring 143*a* is fastened on a start lever 131. The start lever 131 is normally biased to its first position by the force of the spring 143*a*. At this time, as shown in FIG. 10, there is a clearance gap between the cam 138 and the lower surface of the cam plate 142.

Before a cold start of the engine, the start lever 131 is rotated toward its second position so that the cam surface 138*a* of the start shaft 143 engages the lower surface of the cam plate 142 to lift up the throttle valve lever 122, thus increasing the extent to which the fuel nozzle is open. At the same time, the rod 138*b* of the start shaft 143 pushes the projection 142*a* on the outer edge of the cam plate 142 to rotate the throttle valve lever 122, thus increasing the extent to which the throttle valve is open. In this manner, upward movement and rotation of the throttle valve are achieved by the rotation of the start shaft 143. Therefore, the air flow increases simultaneously with the increase of the fuel flow to obtain a smooth start and initial idle operation of the engine.

After idling of the engine, when the throttle valve lever 122 is rotated towards its fully open position, the throttle valve lever 122 is lifted up by the normal cam mechanism and moved away from the cam surface 138*a*, whereby the start shaft 143 is returned to its first position by the force of the spring 143*a*. In its first position, the start shaft and related components do not engage or interfere with the throttle valve movement.

In this embodiment, the cam surface 138*a* and the push rod 138*b* are provided on the start shaft 143. The cam surface 138*a* can be engaged with the cam plate 142 integral with the throttle valve lever 122, and the push rod 138*b* can be engaged with the projection 142*a* of the cam plate 142. Therefore, the height of the cam surface 138*a* from the start shaft center and the position and length of the push rod 138*b* can be adjusted or altered to adapt to the starting characteristics of the engine. Additionally, the increase in fuel flow and the increase in air flow can be separately adjusted.

Fourth Embodiment

Figure 11:
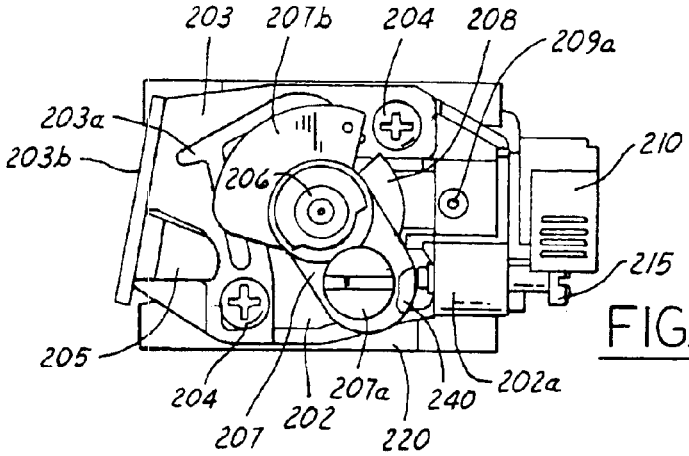
FIG. 11 is a plan view of a rotary throttle valve-type carburetor provided with a starting device according to a fourth embodiment of the present invention.
Figure 12:
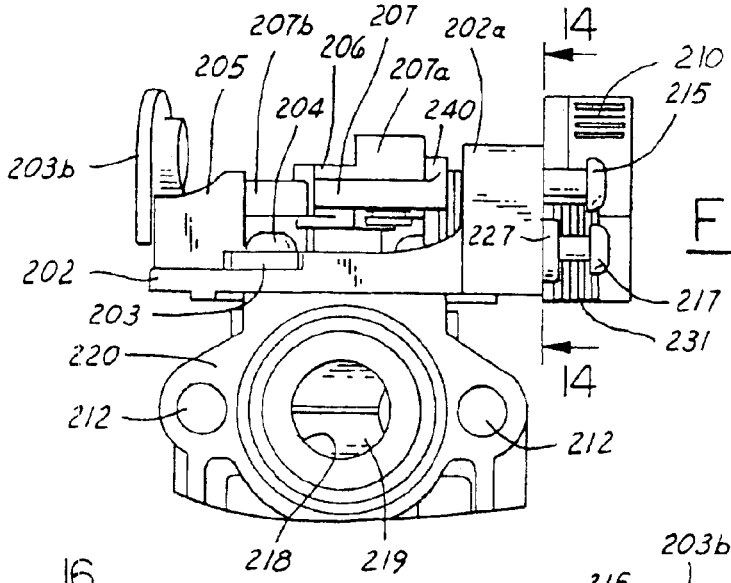
FIG. 12 is a front view showing the starting device of the rotary throttle valve-type carburetor of FIG. 11.

Another embodiment carburetor is shown in FIGS. 11 to 19. As shown in FIGS. 11 and 12, the rotary throttle valve-type carburetor provided with a starting device has a carburetor body 220 made of aluminum and provided with an air intake passage 218 extending therethrough and a pair of left and right through-holes 212 provided on front and rear end flanges of the carburetor body 220, respectively. An air cleaner is connected on the front end flange in FIG. 11, and the rear end flange is connected through a heat insulating pipe to the wall surrounding an intake port of the engine by a pair of bolts extending through the through-holes 212. A throttle valve 219 having a throttle hole is rotatably and vertically movably fitted into a cylindrical valve chamber perpendicular to the air intake passage 218. A valve shaft 206 extends from the upper end of the throttle valve 219, through a lid plate 202 that is preferably formed of synthetic resin, for closing the valve chamber. A throttle valve lever 207 is mounted on the upper end of the valve shaft 206. A swivel 207*a* for fastening an inner cable of a remote control cable is supported on one end of the throttle valve lever 207. An arcuate cam 207*b* extends outwardly from the throttle valve lever 207. A cam groove of varied depth is provided in the lower surface of the cam 207*b*, and a follower (not shown) supported on the lid plate 202 is engaged with the cam groove to constitute a cam mechanism.

The lid plate 202 has an inverted L-shape in FIG. 11, and is put on the upper face of the carburetor body 220 together with a reinforcing plate 203 made of metal having a ledge 203*a* and fastened to the carburetor body 220 by a pair of bolts 204. Mounting metal fittings (not shown) for supporting an end of an outer tube of the remote control cable is threadedly supported on an upstanding wall 203*b* of the reinforcing plate 203. An inner wire inserted into the outer tube is extended over a guide wall 205 of the lid plate 202 and fastened to the swivel 207*a*.

Figure 13:
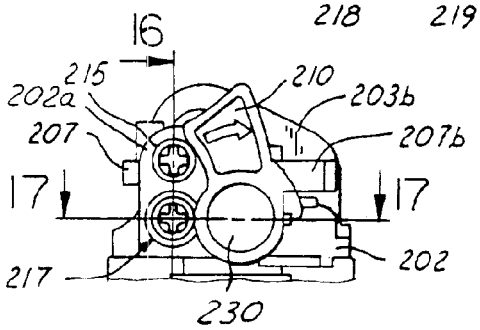
FIG. 13 is a side sectional view showing the rotary throttle valve-type carburetor of FIG. 11.
Figure 14:
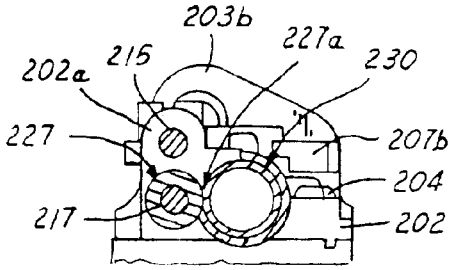
FIG. 14 is a side sectional view showing the starting device of the rotary throttle valve-type system carburetor of FIG. 11.
Figure 15:
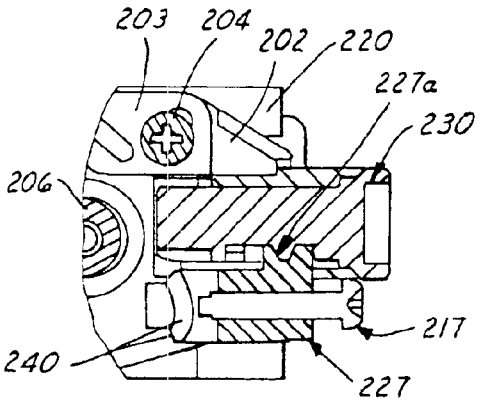
FIG. 15 is a fragmentary plan sectional view showing the starting device of the rotary throttle valve-type carburetor of FIG. 11.
Figure 19:
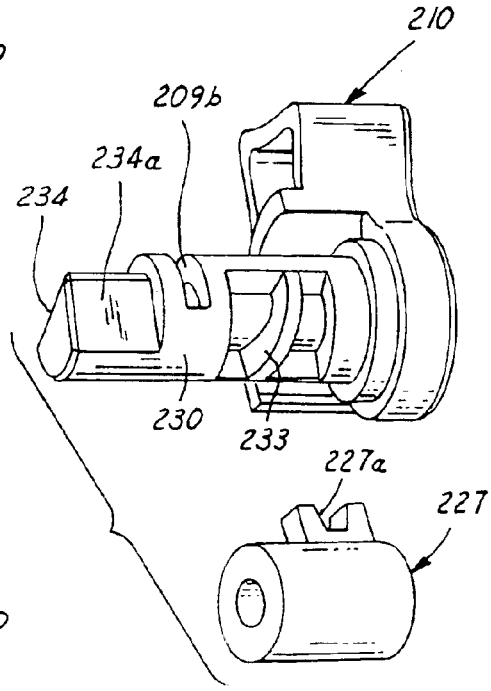
FIG. 19 is an exploded perspective view showing a part of the starting device of the rotary throttle valve-type carburetor of FIG. 11.

An upstanding projection 202*a* is formed integral with the lid plate 202, an idling adjusting bolt 215 is threadedly fitted in the upper portion of the projection 202*a*, and a pushing shaft 227 threadedly receives a push rod 217 and is un-rotatably and axially movably supported at the lower portion of the projecting wall 202*a*. Further, a start shaft 230 (FIGS. 13–15) provided with a start lever 210 is rotatably fitted into a cylindrical portion in the projection 202*a*, as shown in FIGS. 13 and 14. As shown in FIGS. 11 and 19, a pin 209*a* supported on the projection 202*a* is engaged with an annular groove 209*b* provided on the start shaft 230. A helical or arcuate projection 233 is partially formed integral with the start shaft 230, and a projecting piece having a groove 227*a* for engagement with the helical projection 233 is provided on the pushing shaft 227. Flat cam surfaces 234 and 234*a* are formed on the end portion of the start shaft 230. When the start lever 210 is in its first position as shown in FIG. 13, the cam surface 234 does not contact the lower side of a cam plate 208 (FIG. 11) formed integral with the throttle valve lever 207. The push rod 217 and cam surface 234 comprise at least part of an actuator associated with the start shaft.

Figure 16:
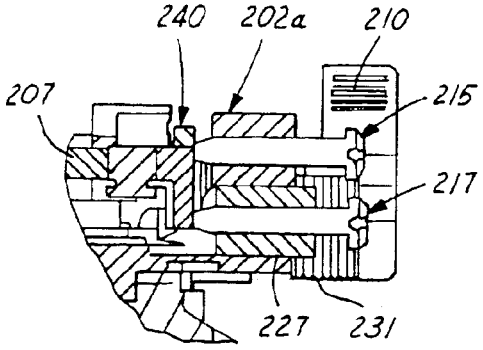
FIG. 16 is a fragmentary front sectional view showing the starting device of the rotary throttle valve-type carburetor of FIG. 11.
Figure 17:
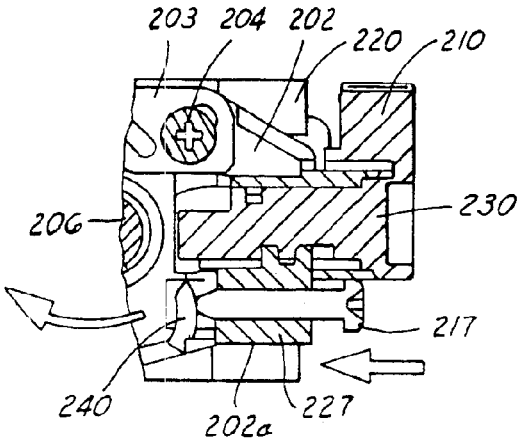
FIG. 17 is a fragmentary front sectional view showing the starting device of the rotary throttle valve-type carburetor of FIG. 11.

As shown in FIGS. 12 and 16, a coil spring 231 is wound about the start shaft 230, and one end of the coil spring 231 is stopped at the projection 202*a* and the other end of the coil spring 231 is stopped at the start lever 210. The start lever 210 is rotated and biased to its first position, shown in FIGS. 13 and 16, by the force of the coil spring 231. A downwardly projecting edge 240 is formed integral with the throttle valve lever 207, an end of the idling adjusting bolt 215 is engaged with the edge 240, and an end of the push rod 217 threadedly fitted in the pushing shaft 227 is arranged to be able to engage with the edge 240. However, normally, the push rod 217 is not in contact with the edge 240.

Figure 18:
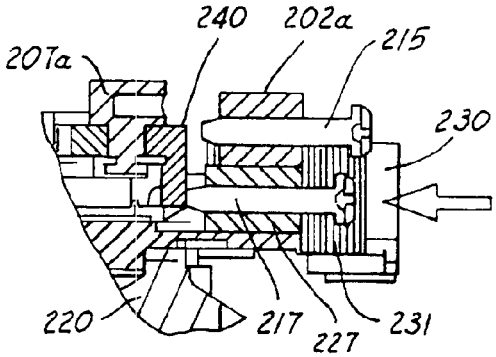
FIG. 18 is a fragmentary front sectional view showing the starting device of the rotary throttle valve-type carburetor of FIG. 11.

At the time of cold start of the engine, when the start lever 210 is moved to its second position as shown in FIG. 18, the pushing shaft 227 in which the helical projection 233 and the groove 227*a* are engaged is advanced forward (to the left as viewed in FIG. 18) and the push rod 217 impinges upon the edge 240 to rotate the throttle valve lever 207 toward its fully open position. At the same time, the start shaft 230 is rotated to engage the cam surface 234*a* with a cam plate 208 integral with the throttle valve lever 207. By doing so, the throttle valve. 219 is lifted up together with the throttle valve lever 207 by the cam surface 234*a* on the start shaft 230.

In this manner, the degree or amount to which the throttle valve 219 and the fuel nozzle are open increases, whereby a rich mixture is supplied to the engine during cranking of the engine and a smooth start of the engine is obtained. Also, since the air quantity increases slightly at the starting of the engine, the initial idling operation after the start is smoother and stable. The amount of upward movement or lift of the throttle valve lever 207 is determined according to the distance from the center of the start shaft 230 to the cam surface 234*a*. Further, the amount that the throttle valve lever 207 is rotated when the edge 240 is pushed by the push rod 217 is adjusted by retracting or advancing the push rod 217 with respect to the pushing shaft 227.

After the engine has been warmed up, when the throttle valve 207 is rotated toward its fully open position, the cam plate 208 rotates together with the throttle valve lever 207 and is disengaged from the cam surface 234*a*. At this time, the start lever 210 is returned to its first position by the force of the coil spring 231. At the same time, the pushing shaft 227, having the projecting piece with the groove 227*a* engaged with the helical projection 233 of the start shaft 230, is retracted to its first position.

Fifth Embodiment

Figure 20:
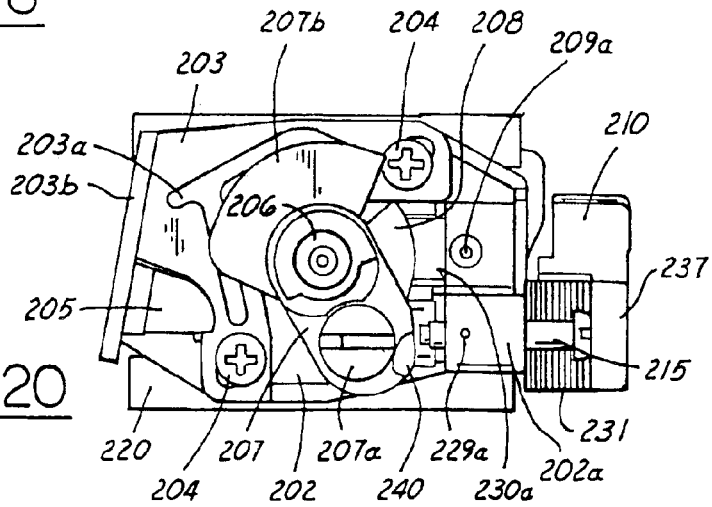
FIG. 20 is a plan view of a rotary throttle valve-type carburetor provided with a starting device according to a fifth embodiment of the present invention.
Figure 21:
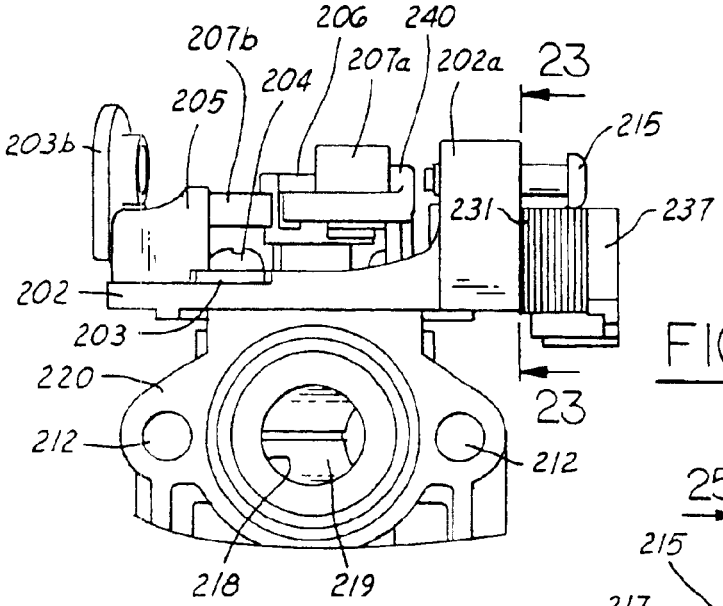
FIG. 21 is a front sectional view showing the starting device of the rotary throttle valve-type carburetor of FIG. 20.
Figure 22:
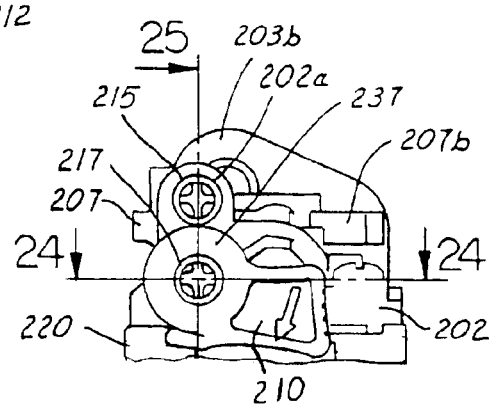
FIG. 22 is a side sectional view showing the starting device of the rotary throttle valve-type carburetor of FIG. 20.
Figure 23:
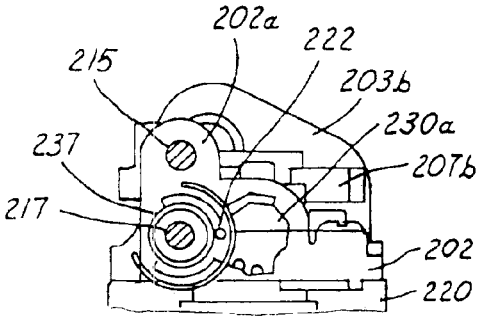
FIG. 23 is a side sectional view taken generally along line 23A—23A of FIG. 21 showing the starting device of the rotary throttle valve-type carburetor.
Figure 27:
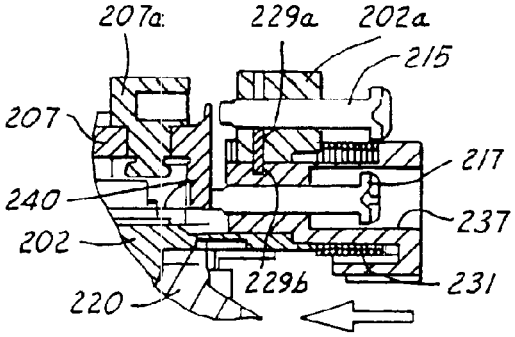
FIG. 27 is a fragmentary front sectional view showing the starting device of the rotary throttle valve-type carburetor of FIG. 20.
Figure 28:
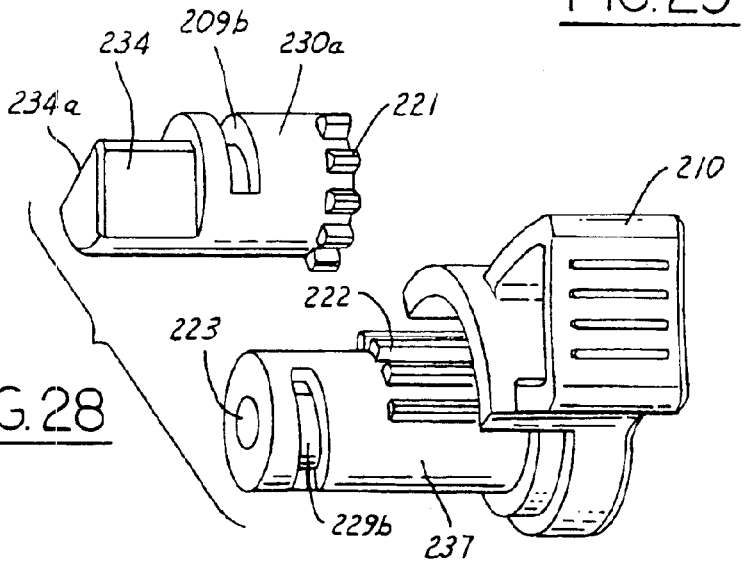
FIG. 28 is an exploded perspective view showing a part of the starting device of the rotary throttle valve-type carburetor of FIG. 20.

In the embodiments shown in FIGS. 20 to 28, a push rod 217 for rotating the throttle valve lever 207 is threadedly supported on a start shaft 237, and a gear 222 (FIGS. 23 and 28) on the cam shaft 237 is meshed with a gear 221 (see FIG. 28) which is provided on a start shaft 230*a* for lifting up the throttle valve lever 207. The idling adjusting bolt 215 is threadedly fitted in the upper portion of the projection 202*a* formed on the right side edge of the lid plate 202, and the start shaft 237 is rotatably and axially movably supported on the cylindrical portion on the lower portion of the projection 202*a*. Further, the cam shaft 230*a* is rotatably and axially un-movably fitted into the cylindrical portion of the projection 202*a*. Therefore, a pin 209*a* supported on the projection 202*a* is engaged with a groove 209*b* provided on the cam shaft 230*a*, as shown in FIGS. 20 and 28. The partial gear 221 is formed integral with the distal end of the cam shaft 230*a*. The flat cam surfaces 234 and 234*a* are formed on the end portion of the cam shaft 230*a*. When the start lever 210 is in its first position the cam surface 234 is adjacent to but not contacting the lower surface of the cam plate 208 (FIG. 20) formed integral with the throttle valve lever 207.

Figure 24:
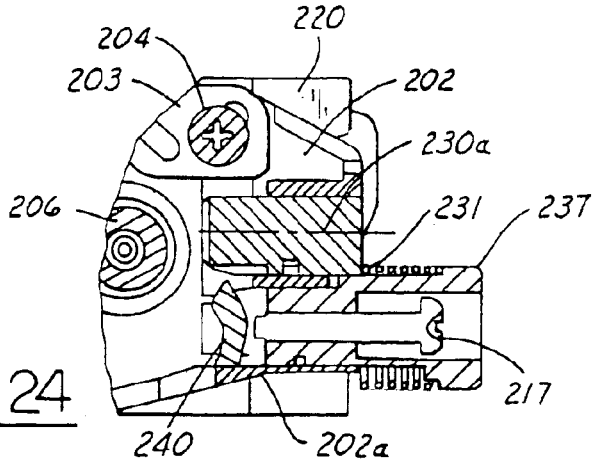
FIG. 24 is a fragmentary plan sectional view taken generally along line 24A—24A of FIG. 22 showing the starting device of the rotary throttle valve-type carburetor.
Figure 25:
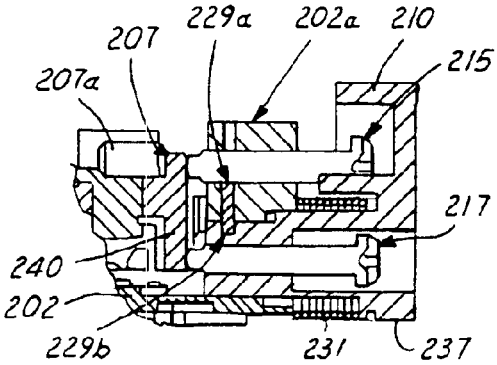
FIG. 25 is a fragmentary front sectional view taken generally along line 25A—25A of FIG. 22 showing the starting device of the rotary throttle valve-type carburetor of FIG. 20.
Figure 26:
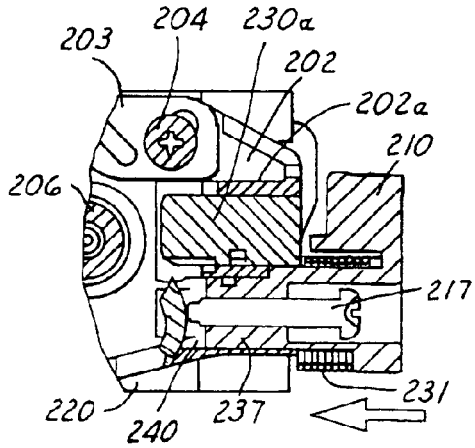
FIG. 26 is a fragmentary front sectional view showing the starting device of the rotary throttle valve-type carburetor of FIG. 20.

As shown in FIGS. 24 and 25, the coil spring 231 is wound about the start shaft 237, and one end of the coil spring 231 is stopped at the projection 202*a* and the other end of the coil spring 231 is stopped at the start lever 210. The start lever 210 is rotated and biased to its first position, shown in FIG. 25, by the force of the coil spring 231. The edge 240 projecting downward is formed integral with the side edge of the throttle valve lever 207, the extreme end of the idling adjusting bolt 215 comes in contact with the edge 240. The push rod 217 which is threadedly fitted in a tapped hole 223 of the start shaft 237 is arranged so that its end is engagable with the edge 240 during at least a portion of the movement of the start shaft 237. However, the push rod 217 is normally not in contact with the edge 240. The push rod 217 and cam surface 234 comprise at least part of an actuator associated with the start shaft.

When a cold engine is going to be started, the start lever 210 is rotated to its second position, as generally shown in FIG. 27. The rotation of the start lever 210 causes the start shaft 237 to be generally axially advanced as guided by a pin 229*a* in the groove 229*b*, and the push rod 217 impinges upon the edge 240 to rotate the throttle valve lever 207 toward its fully open position. At the same time, the cam shaft 230*a* having the gear 221 meshed with the gear 222, is rotated. The cam surface 234*a* engages the cam plate 208 on the throttle valve lever 207, and the throttle valve 219 is lifted up together with the throttle valve lever 207. In this manner, the amount to which the throttle valve 219 and fuel nozzle are open increases, whereby a rich mixture is supplied to the engine upon cranking of the engine to facilitate starting and initial idle operation as the engine is warmed up. The amount of upward movement (lift) of the throttle valve lever 207 is determined according to the distance from the center of the cam shaft 230*a* to the cam surface 234*a*. Further, the amount that the throttle valve lever 207 is rotated when the edge 240 is pushed by the push rod 217 is adjusted by retracting or advancing the push rod 217 with respect to the start shaft 237.

After the engine has been warmed up, when the throttle valve lever 207 is rotated toward its fully open position, the cam plate 208 is rotated together with the throttle valve lever 207 and is disengaged from the cam surface 234*a*. At this time, the start lever 210 is returned to its first position by the force of the coil spring 231. The cam shaft 230*a* having the gear 221 meshed with the gear 222 of the start shaft 237 is also returned to its first position.

Sixth Embodiment

Figure 29:
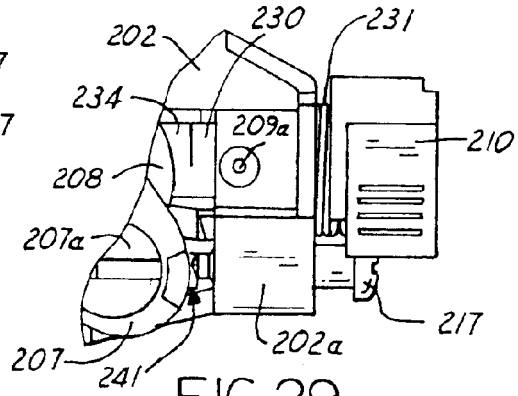
FIG. 29 is a fragmentary plan view of a rotary throttle valve-type carburetor provided with a starting device according to a sixth embodiment of the present invention.
Figure 30:
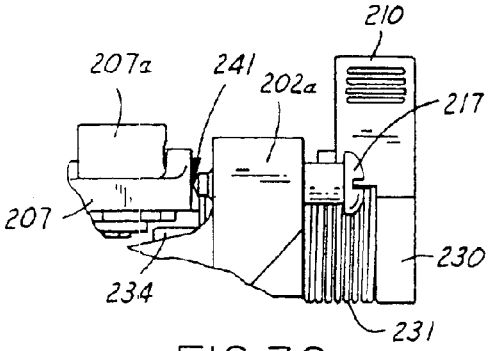
FIG. 30 is a fragmentary front view showing the starting device of the rotary throttle valve-type carburetor of FIG. 29.
Figure 31:
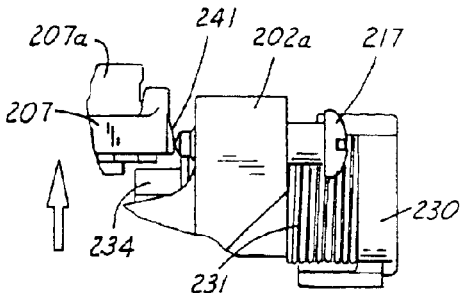
FIG. 31 is a fragmentary front view showing the starting device of the rotary throttle valve-type carburetor of FIG. 29.

In the embodiments shown in FIGS. 29 to 31, when a cam surface 241 formed in a side edge of a throttle valve lever 207 comes in contact with a push rod 217 serving as an idling adjusting bolt to rotate a start shaft 230 and lift up the throttle valve lever 207, a cam surface 241 is pushed so that the throttle valve lever 207 is slightly rotated toward its wide open position. The push rod 217 and a cam surface 234 define at least part of an actuator associated with the start shaft. The start shaft 230 having a start lever 210 is rotatably and axially un-movably supported on the cylindrical portion of the projection 202*a* on the lid plate 202. In order to accomplish this, a pin 209*a* supported on the projecting wall 202*a* is engaged with an annular groove (as in the embodiment of FIG. 19) provided on the peripheral surface of the start shaft 230. Cam surfaces 234 and 234*a* are formed on the end of the start shaft 230 and positioned below the cam plate 208 formed integral with the throttle valve lever 207. One end of the coil spring 231 wound about the start shaft 230 is stopped on the projection 202*a* and the other end of the coil spring 231 is stopped at the start lever 210, similar to the embodiment of FIG. 12. A push rod 217 serving as an idling adjusting bolt threadedly supported on the projection 202*a* has its end engaged with the cam surface 241 formed on the side edge of the throttle valve lever 207 and is biased by a return spring (not shown) that returns the throttle valve to an idling position. The cam surface 241 is formed into an inclined surface which becomes higher (projects toward the push rod 217) gradually from the upper portion to the lower portion of the throttle valve lever 207.

In its first position shown in FIGS. 29 and 30, the end of the push rod 217 is engaged with the upper portion of the cam surface 241 to control the normal idling position of the throttle valve lever 207 and hence, the throttle valve 219. When a cold engine is to be started, the start lever 210 is rotated to its second position so that the cam surface 234 engages the cam plate 208 to lift the throttle valve lever 207. At the same time, the lower portion of the cam surface 241 is engaged by the end of the push rod 217, and the throttle valve lever 207 is rotated toward its fully open position. Due to an increase in fuel quantity caused by upward movement of the throttle valve lever 207 (and hence an increase in the flow area of the fuel nozzle), and an increase in air quantity caused by rotation of the throttle valve lever 207, a rich fuel and air mixture is supplied to the engine to facilitate starting the engine. In a portable work machine in which rotation of the crank shaft of the engine is transmitted to a work tool through a centrifugal clutch, the air quantity at the time of cold start of the engine can be adjusted by the position of the push rod 217 relative to the projecting wall 202*a*, and this can be done independently of the adjustment of the fuel quantity so that the work tool is not rotated as soon as the engine is started.

Seventh Embodiment

Figure 32:
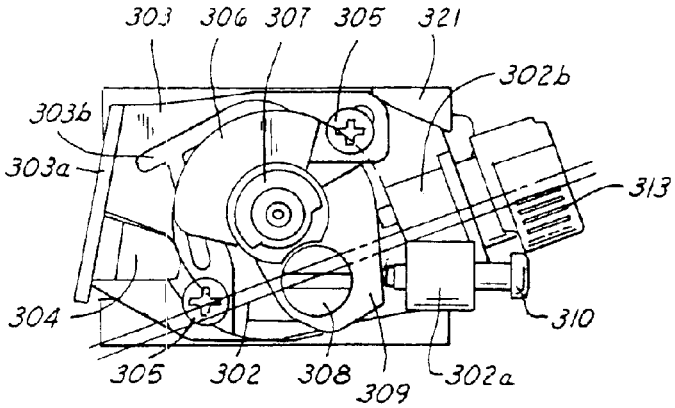
FIG. 32 is a plan view of a rotary throttle valve-type carburetor provided with a starting device according to a seventh embodiment of the present invention.
Figure 34:
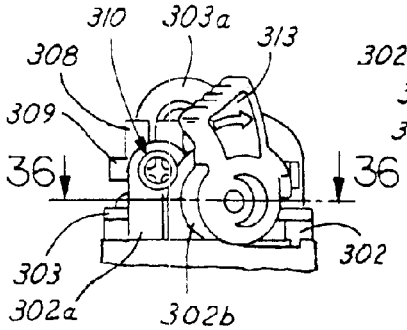
FIG. 34 is a side view showing the starting device of the rotary throttle valve-type carburetor of FIG. 32.
Figure 33:
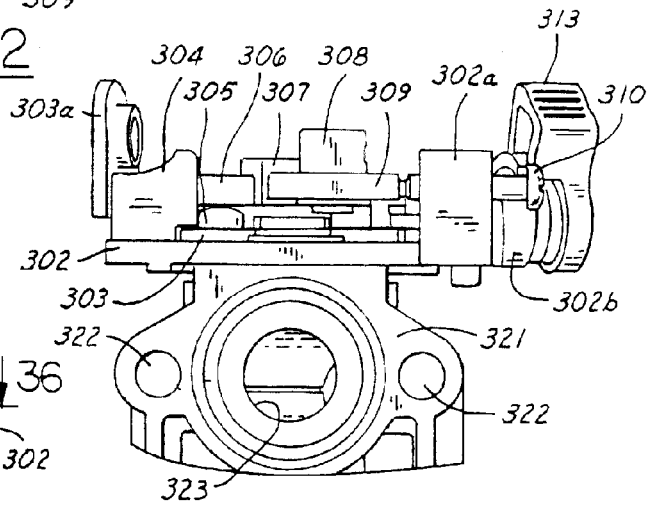
FIG. 33 is a front view showing the starting device of the rotary throttle valve-type carburetor of FIG. 32.

As shown in FIGS. 32 to 34, a carburetor body 321 through which an air intake passage 323 extends is connected to a wall surrounding an intake port of the engine by bolts inserted into left and right through-holes 322 and typically through a heat insulating pipe. A vertical cylindrical valve chamber crossing the air intake passage 323 is provided in the carburetor body 321, and a throttle valve having a throttle hole is rotatably and vertically movably fitted into the valve chamber. The valve chamber is closed by a lid plate 302 preferably formed of synthetic resin and fastened together with an L-shaped metal reinforcing plate 303 by a plurality of bolts 305. A valve shaft 307 formed integral with the throttle valve has a throttle valve lever 309 connected to the upper end extending through the lid plate 302. A swivel 308 is rotatably supported on one end of the throttle valve lever 309, and a cam portion 306 is formed on the other end of the throttle valve lever 309.

An upright wall 303*a* is formed preferably by upwardly bending the left edge of a reinforcing plate 303 having a projection 303*b*. An end of an outer tube of a remote control cable is secured to the wall 303*a* by metal fittings, not shown. An inner wire inserted into the outer tube extends over a guide projecting wall 304 formed integral with the lid plate 302 and is connected to the swivel 308. An idling adjusting bolt 310 is threadedly supported on the projection 302*a* that extends upward from the right edge of the lid plate 302, and the throttle valve lever 309 is placed in contact with the idling adjusting bolt 310, as shown in FIG. 32, by the force of a return spring (not shown).

Figure 35:
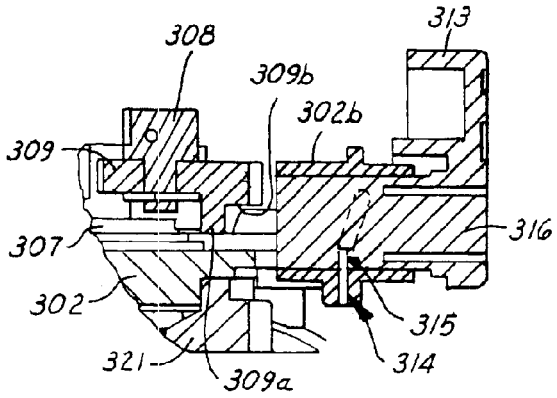
FIG. 35 is a fragmentary side sectional view showing the starting device of the rotary throttle valve-type carburetor of FIG. 32.
Figure 36:
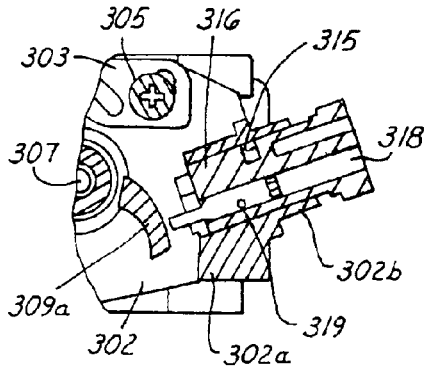
FIG. 36 is a plan sectional view taken generally along line 36A—36A in FIG. 34 showing the starting device of the rotary throttle valve-type carburetor.

For increasing the quantity of fuel and air delivered to the engine at the time of a cold start of the engine, a cylindrical boss portion 302*b* is formed adjacent to the projection 302*a*, and a start shaft 316 having a start lever 313 is fitted into the boss portion 302*b*. As shown in FIG. 35, a helical or arcuate groove 315 is formed on the start shaft 316, and a pin 314 received in the groove 315 is secured to the boss portion 302*b*. As shown in FIG. 36, a push rod 319 is threadedly fitted in a tapped hole 318 provided eccentrically in the start shaft 316. The push rod 319 has a cam surface 320 on the peripheral surface of the free end of the push rod. An arcuate projection 309*a* extends downwardly from a lower surface 309*b* of the throttle valve lever 309 and is faced toward the end of the push rod 319. The push rod 319 and cam surface 320 define at least in part an actuator associated with the start shaft.

Figure 37:
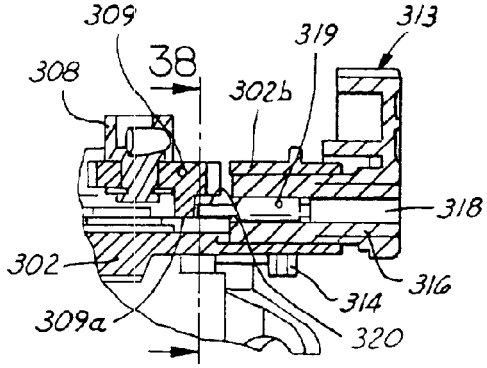
FIG. 37 is a fragmentary front sectional view showing the starting device of the rotary throttle valve-type carburetor of FIG. 32.
Figure 38:
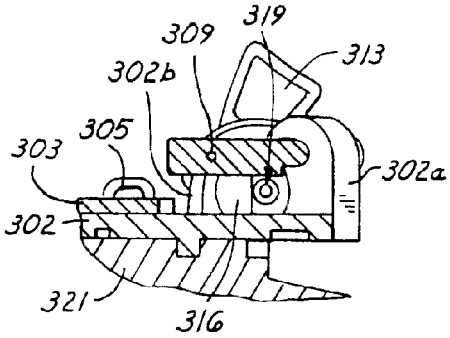
FIG. 38 is a fragmentary side sectional view taken generally along line 38A—38A in FIG. 37 showing the starting device of the rotary throttle valve-type carburetor.
Figure 39:
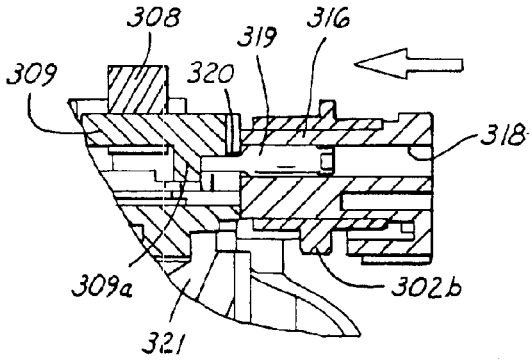
FIG. 39 is a fragmentary front sectional view showing the starting device of the rotary throttle valve-type carburetor of FIG. 32.

As shown in FIGS. 36 and 37, when the start lever 313 is in its first position, the push rod 319 does not contact the lower surface 309*b* of the throttle valve lever 309 or the projection 309*a*. When it is desired to start a cold engine, the start lever 313 and start shaft 316 are rotated to their second position (shown in FIGS. 38 and 39), the push rod 319 supported on the start shaft 316 moves upward to engage the cam 320 with the lower surface 309*b* to lift up the throttle valve together with the throttle valve lever 309. Lifting the throttle valve increases the flow area of the fuel nozzle. At the same time, the start shaft 316, having the groove 315 in engagement with the pin 314, is advanced. The projection 309*a* is pushed leftward (as viewed in FIG. 39) by the push rod 319 of the start shaft 316, and the throttle valve lever 309 rotates slightly toward its wide open position permitting increased air flow through the hole in the throttle valve shaft. In this manner, an increase in the amount of fuel and air are achieved to facilitate the smooth start of the engine. The amount that the throttle valve lever 309 is lifted can be adjusted by replacing the push rod 319 threadedly fitted in the tapped hole 318 with one different in outside diameter at its end, or by changing the eccentricity of the tapped hole 318 to change the position of the cam surface 320. Further, the amount that the throttle valve lever 309 is rotated can be adjusted by advancing or retracting the push rod 319 in the tapped hole 318.

When the throttle valve lever 309 is rotated towards the wide or fully open throttle position after the start of the engine, the push rod becomes disengaged from the throttle valve lever 309 and the operating lever 313 is returned to its first position by the force of a coil spring (not shown) wound about the start shaft 316 and having one end stopped at the boss portion 302*b* and the other end stopped at the operating lever 313.

Eighth Embodiment

Figure 40:
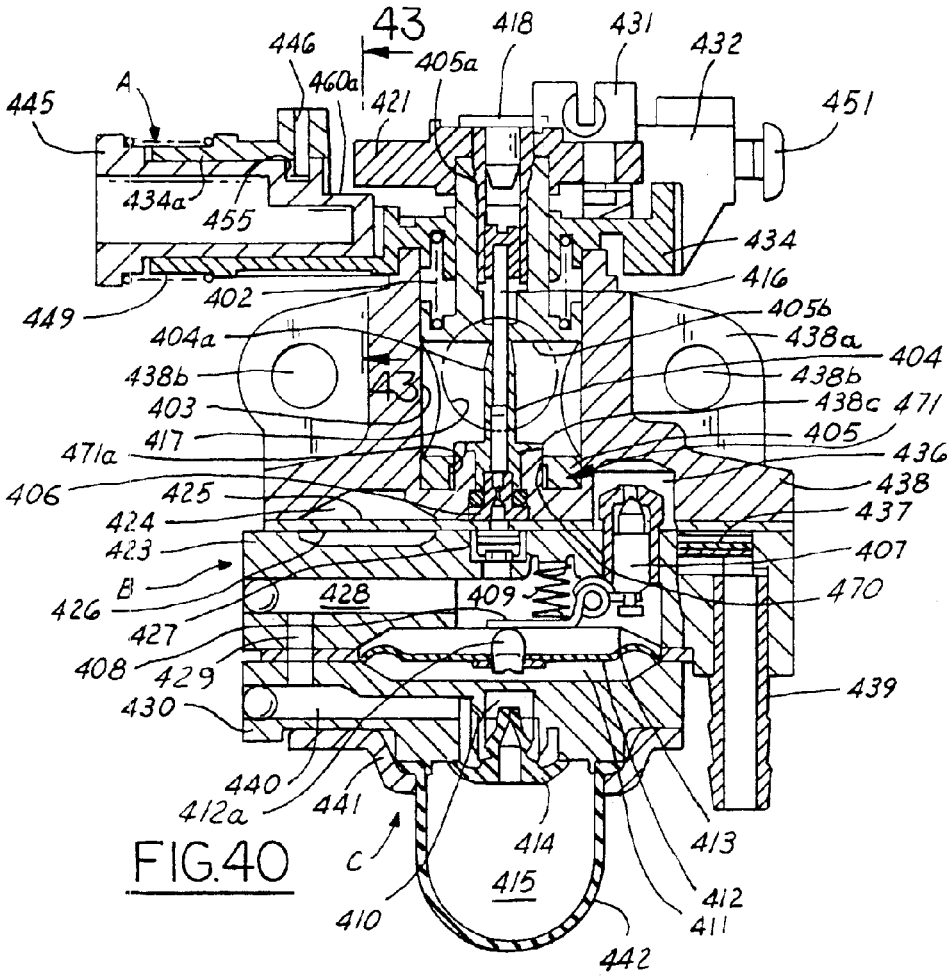
FIG. 40 is a front sectional view of a rotary throttle valve-type carburetor provided with a starting device according to an eighth embodiment of the present invention.
Figure 41:
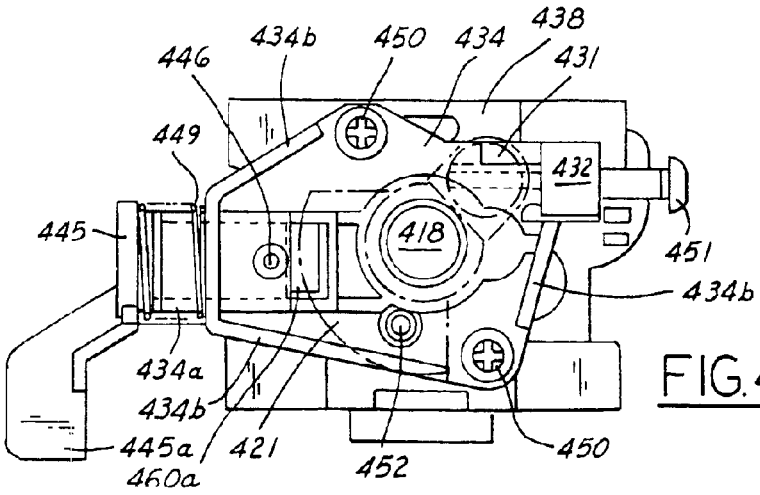
FIG. 41 is a plan view showing the starting device of the rotary throttle valve-type carburetor of FIG. 40.

FIG. 40 is a front sectional view of a rotary throttle valve-type carburetor provided with a start fuel increasing mechanism according to one embodiment of the present invention. FIG. 41 is a plan view of the carburetor showing a throttle valve lever. The rotary throttle valve-type carburetor provides a rear end flange 438*a* on a carburetor main body 438. The flange 438*a* is placed in contact with an intake port of the engine through a heat insulating pipe, not shown, and is secured to the wall of the engine by means of a pair of bolts extending through left and right through holes 438*b*. The carburetor body 438 is provided with a start fuel increasing mechanism A, a throttle valve lever 421, a fuel metering supply mechanism B, and a purge-primer pump C. The carburetor main body 438 is provided with a cylindrical air intake passage 417 longitudinally extending perpendicular to the paper surface and a cylindrical valve chamber 403 perpendicular to the air intake passage 417. The valve chamber 403 has a throttle valve 405 rotatably and vertically movably (axially movably) inserted. The throttle valve 405 is provided with a laterally extending throttle hole 405*b*, and a valve shaft 405*a* upwardly extending through a lid plate 434 for closing the valve chamber 403 and has a throttle valve lever 421 connected to the upper end of the valve shaft 405*a*.

A spring 402 surrounding the valve shaft 405*a* is interposed between the lid plate 434 and the throttle valve 405, and has one end stopped at the lid plate 434 and the other end stopped at the throttle valve 405, respectively. An upper end portion of a needle 416 is threadedly fitted in the hollow valve shaft 405*a*, which is closed by a cap 418. A jet 406 and a fuel supply pipe 404 are fitted and secured to the bottom wall of the valve chamber 403. The fuel supply pipe 404 receives the free end of the needle 416 for reciprocation to adjust the flow area of an opening of a fuel nozzle 404*a* as a function of the vertical movement of the throttle valve 405. In the illustrated embodiment, a columnar support 438*c* is projected from the bottom wall of the valve chamber 403 to the throttle hole 405*b* in order to receive at least in part the fuel supply pipe 404. The throttle valve shaft 405*a* has an opening 470 through its lower end and extending into the throttle hole 405*b* to receive the support 438*c* and fuel supply pipe 404.

In the fuel metering supply mechanism B, an intermediate plate 423 is connected to the lower end of the carburetor main body 438 with a fuel pump diaphragm 425 sandwiched therebetween. A pulsation pressure chamber 424 for introducing pulsation pressure of a crank chamber of a 2-stroke engine is defined on the upper side of the diaphragm 425, and a pump chamber is defined on the lower side of the diaphragm 425. An end plate fuel metering 430 is connected to the intermediate plate 423 with a fuel metering diaphragm 412 sandwiched therebetween. A fuel metering chamber 413 is defined on the upper side of the diaphragm 412 and an atmospheric chamber 411 is defined on the lower side of the diaphragm 412. A lever 408 rotatably supported on the wall of the fuel metering chamber 413 has one end placed in contact with a projecting piece 412*a* on the center portion of the diaphragm 412 by the force of a spring 409 interposed between the lever 408 and the top wall of the fuel metering chamber 413, and has the other end connected to an inlet valve 407.

When the diaphragm 425 is vibrated or displaced vertically by crankcase pulsation pressure in the pulsation pressure chamber 424, fuel in a fuel tank (not shown) is drawn into the pump chamber 426 via a pipe 439, a filter 437 and an inlet valve (not shown). Fuel in the pump chamber 426 is discharged into the fuel metering chamber 413 via an outlet valve (not shown), a chamber 436 of the carburetor body 438 and the inlet valve 407. When the fuel metering chamber 413 is filled with fuel, the diaphragm 412 is pushed down and the inlet valve 407 is closed with counterclockwise rotation of the lever 408 (as viewed in FIG.40). Conversely, when fuel in the fuel metering chamber 413 is reduced, the diaphragm 412 is lifted up by intake vacuum pressure in the fuel metering chamber 413 and atmospheric pressure in the atmospheric chamber 411, and the inlet valve 407 opens with clockwise rotation of the lever 408 against the force of the spring 409. Fuel in the fuel metering chamber 413 is drawn into the throttle hole 405*b* via a check valve 427 preferably made of a thin elastic circular plate, the jet 406, the fuel supply pipe 404 and the fuel nozzle 404*a*, and is supplied to the engine while mixing with air flowing through the air intake passage 417.

In the purge-primer pump C for purging air and fuel vapor from the carburetor and replenishing fuel to the fuel metering chamber 413 before the start of the engine, a collapsible bulb 442 is connected to the lower surface of the end plate 430 by a keep plate 441 to define a pump chamber 415. A composite valve 414 provided integrally with a mushroom-shaped suction valve and a discharge valve is connected to a center wall of the pump chamber 415. When the bulb 442 is collapsed or depressed, fuel vapor or air in the pump chamber 415 pushes open the discharge valve of the composite valve 414 and flows out into a chamber 410, and returns to the fuel tank via a passage not shown. When the bulb 442 is released, the pump chamber 415 assumes vacuum pressure upon expansion of the bulb, and fuel vapor, air and/or some liquid fuel in the fuel metering chamber 413 lift open the peripheral edge of the composite valve 414 via passages 428, 429 and 440 and is drawn into the pump chamber 415.

As shown in FIG. 41, the peripheral edge of the lid plate 434 is reinforced by ribs 434*b* and connected to the carburetor body 438 by a pair of bolts 450. The lid plate 434 has a boss portion 432 that threadedly receives an idling adjusting bolt 451. The idling adjusting bolt 451 controls a return position or an idling position of the throttle valve lever 421 caused by the force of the coil spring 402 (FIG. 40).

A cam surface on the lower side of the throttle valve lever 421, a ball 452 supported on the lid plate 434 and the coil spring 402 for biasing and engaging the cam surface with the ball 452 constitute a first cam mechanism. When the throttle valve lever 421 is rotated counterclockwise from an idling position shown in FIG. 41 toward its position at wide open throttle, the throttle valve lever 421, the throttle valve 405 and the needle 416 are lifted up by the engagement of the cam surface and the throttle valve lever 421 and the ball 452. And the extent to which the throttle hole 405*a* is open relative to the air intake passage 417, as well as the extent to which the fuel nozzle 404*a* is open, is increased.

In FIG. 40, there is shown a relation between the throttle hole 405*b* and the air intake passage 417 which are perpendicular to each other. However, actually, the idling position of the throttle valve lever 421 is controlled by the adjusting bolt 451, and the throttle hole 405*b* is disposed obliquely relative to the air intake passage 417.

Figure 42:
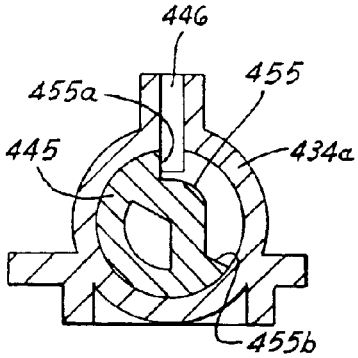
FIG. 42 is a side sectional view showing a part of the starting device of the rotary throttle valve-type carburetor of FIG. 40.

In the start fuel increasing mechanism A of the rotary throttle valve-type carburetor, a start shaft 445 preferably hollow to reduce weight is rotatably supported on a cylindrical portion 434*a* as a bearing portion formed in the left end of the lid plate 434. A retaining pin 446 projecting from the cylindrical portion 434*a* is engaged with a groove 455 formed on the outer peripheral surface of the start shaft 445. As shown in FIG. 42, the groove 455 of the start shaft 445 is provided with spaced apart end walls 455*a* and 455*b*. The range of rotation of the start shaft 445 is controlled by the retaining pin 446, and the starting shaft 445 is normally rotated and biased to a first position (shown in FIG. 42) by the force of a spring 449. The spring 449 (FIG. 41) is wound about the outer peripheral surface of the cylindrical portion 434*a*, and one end of the spring 449 is stopped at a start lever 445*a* of the start shaft 445 and the other end of the spring 449 is stopped at the cylindrical portion 434*a*.

Figure 43:
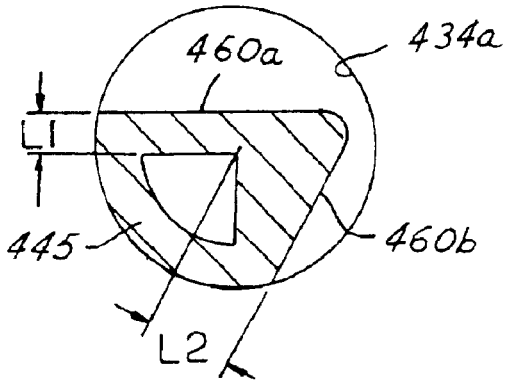
FIG. 43 is a side sectional view showing a part of the starting device of the rotary throttle valve-type carburetor of FIG. 40.

A second cam mechanism is provided between the start shaft 445 and the throttle valve lever 421, in which an end of the start shaft 445 extends below the throttle valve lever 421 as best seen in FIG. 40. The start shaft 445 has a flat cam surface 460*a* not in contact with the lower surface of the throttle valve lever 421 and a flat cam surface 460*b* (FIG. 43) in contact with the lower surface of the throttle valve lever 421. The cam surfaces 460*a* and 460*b* of the start shaft 445 are disposed at different heights or distances from the center of the start shaft providing cam lifts L1, L2. The cam surface 460 defines at least part of an actuator associated with the start shaft.

In this embodiment, there is provided, at the lower end of the throttle valve 405, shown in FIG. 40, an air passage 471 which communicates the throttle hole 405*b* with the intake passage 417 in the area of the air passage 471 when the throttle valve 405 is lifted up by the second cam mechanism. More specifically, in the embodiment shown, the air passage 471 is a split groove 471*a* provided in the lower end surface of the throttle valve 405 generally, adjacent to the opening 470. The split groove 471*a* extends in a direction crossing the throttle hole 405*b*. and is wider than the outside diameter of the support 438*c*. Preferably, the groove 471*a* does not communicate with the air intake passage until the throttle valve is moved or predetermined distance from its idle position.

When a cold engine is going to be started, the start shaft 445 is rotated against the force of the spring 449 until the end wall 455*b* impinges on the retaining pin 446. The cam surface 460*b* comes in contact with the lower surface of the throttle valve lever 421 and lifts up the throttle valve lever 421 to increase the opening or flow area of the fuel nozzle. Further, the split groove 471*a* crosses the air intake passage 417, and air in the air intake passage 417 upstream of the throttle valve 405 flows downstream of the air intake passage 417 via the split groove 471*a* to increase the quantity of air delivered from the carburetor. In this manner, the cold starting of the engine is facilitated and a smoother initial engine idling is obtained.

Ninth Embodiment

Figure 44:
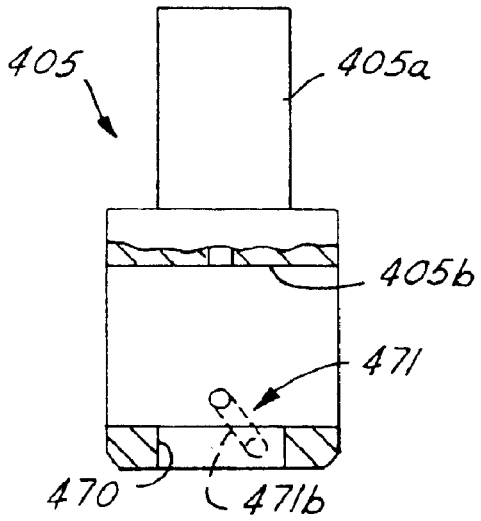
FIG. 44 is a front sectional view of a rotary throttle valve-type carburetor provided with a starting device according to a ninth embodiment of the present invention.
Figure 45:
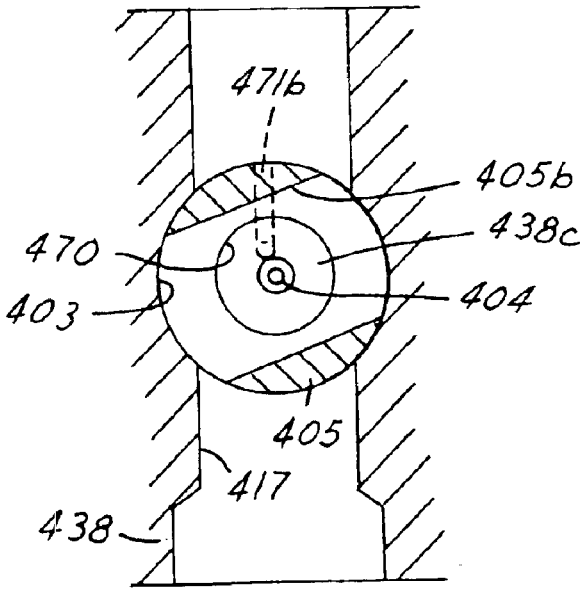
FIG. 45 is a plan view showing a part of the starting device of the rotary throttle valve-type carburetor of FIG. 44.
Figure 46:
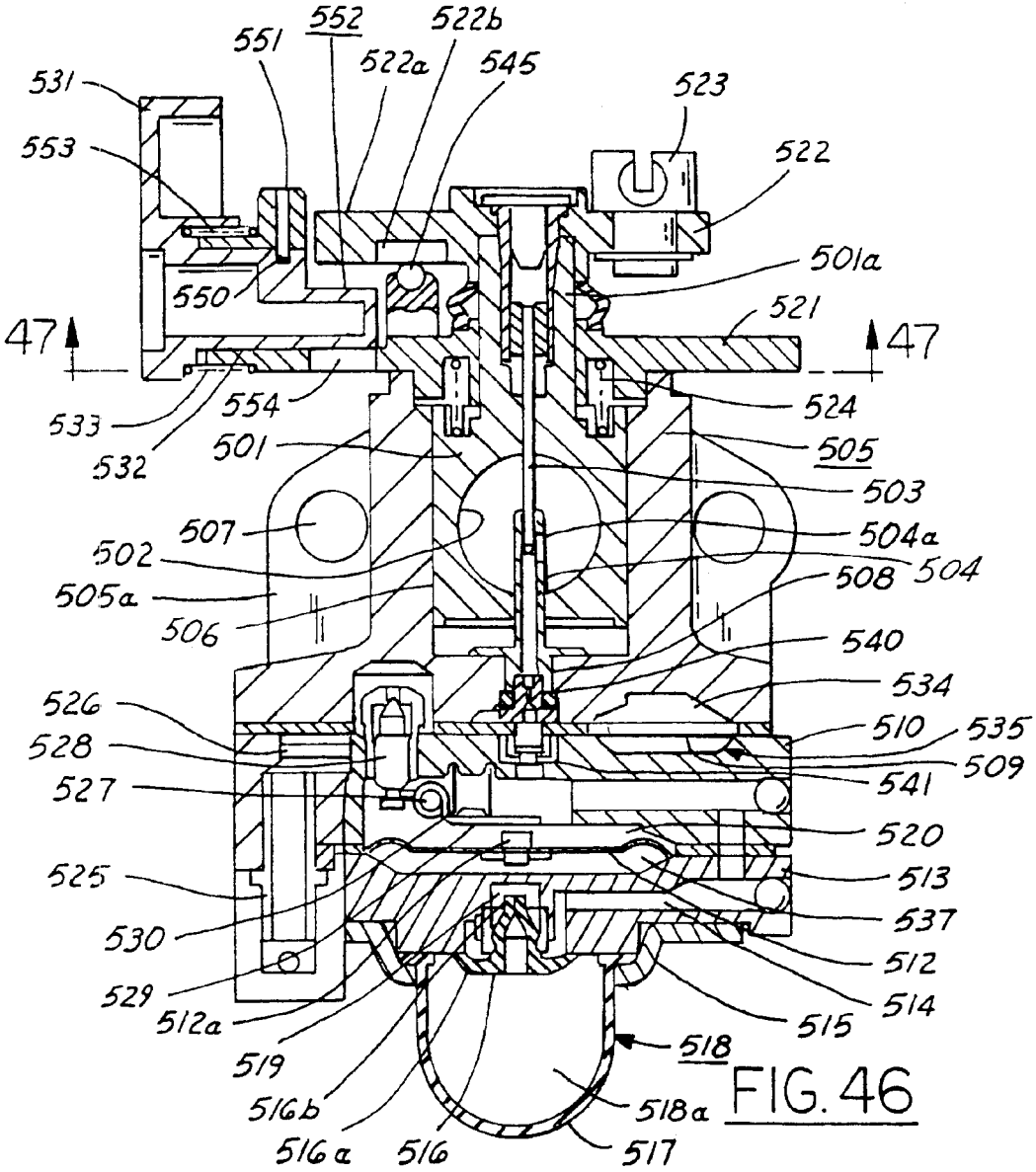
FIG. 46 is a front sectional view of a rotary throttle valve-type carburetor provided with a starting device according to a tenth embodiment of the present invention.
Figure 47:
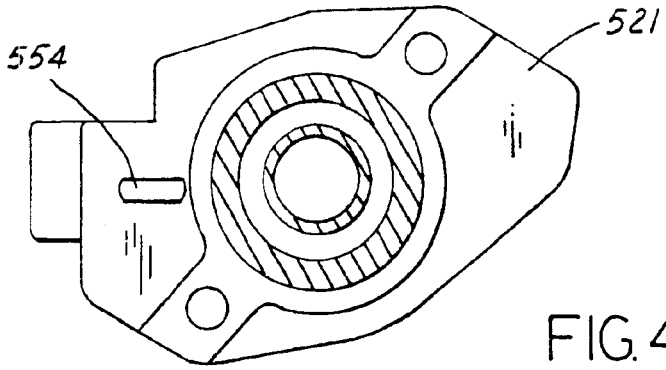
FIG. 47 is a fragmentary sectional view taken generally along line 47A—47A of FIG. 46 showing a lid plate of the starting device of the rotary throttle valve-type carburetor.
Figure 48:
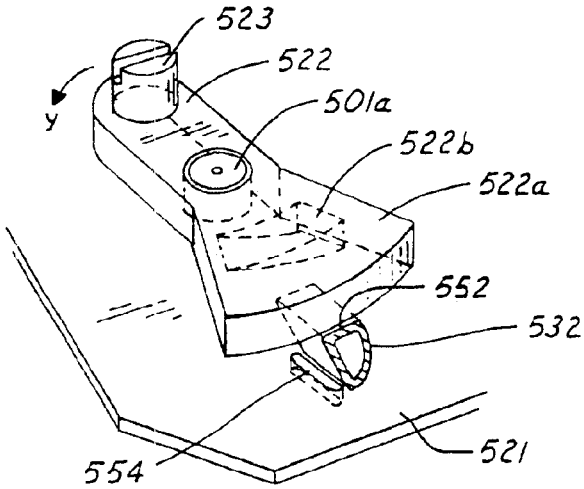
FIG. 48 is a perspective partial sectional view showing a part of the starting device of the rotary throttle valve-type carburetor of FIG. 46.

In the embodiment shown in FIGS. 44 and 45, the air passage 471 is an inclined bore 471*b*, instead of the groove 471*a* of the prior embodiment. The bore 471*b* is open to the throttle hole 405*b* at one end and the outer peripheral surface at the lower end of the throttle valve 405 at its other end. The rest of the carburetor may be the same as discussed in the prior embodiment with the same reference numbers used for similar or identical components.

In the first position of the start shaft 445, the cam surface 460*a* of the start shaft 445 extends below the throttle valve lever 421, the passage 471*b* is positioned lower than the air intake passage 417, and only the throttle hole 405*b* is merely communicated with the air intake passage 417. Normally, the end of the inclined passage 471*b* is closed by the inner peripheral surface of the valve chamber 403, but when the throttle valve lever 421 is lifted up by the second cam mechanism (when the start shaft is rotated to its second position), the end of the inclined passage 471*b* comes into communication with the air intake passage 417.

After the engine has been started, the throttle valve lever 421 is rotated toward the fully open throttle position and is disengaged from the cam surface 460*b*. The start shaft 445 is returned to its first position shown in FIG. 40 by the force of the spring 449.

Tenth Embodiment

Figure 49:
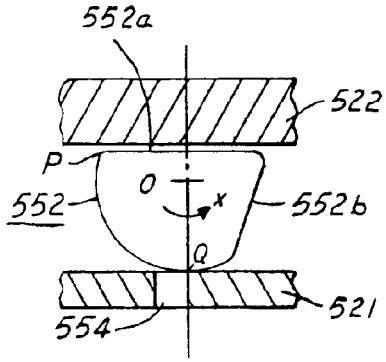
FIG. 49 is a fragmentary side sectional view showing a part of the starting device of the rotary throttle valve-type carburetor of FIG. 46.

In the embodiment shown in FIGS. 46 to 50, in order to supply a rich fuel and air mixture to the engine when the engine is started, a start shaft 532 having a start lever 531 is fitted into a boss portion 553 of the lid plate 521. A pin 551 secured to the boss portion 553 is engaged with a groove 550 of the start shaft 532. A spring 533 is interposed between the start lever 531 and the boss portion 553, and the start lever 531 is rotated and biased to its first position by the force of the spring 553. As shown in FIG. 49, a cam 552 on the end portion of the start shaft 532 is provided with a flat surface 552*a* and a cam surface 552*b*, and normally, the flat surface 552*a* projects below the throttle valve lever 522 and is not in contact with the lower surface of the throttle valve lever 522. When the start lever 531 is moved to its second position, the cam surface 552*b* formed on the end of the start shaft 532 comes in contact with the lower surface of the throttle valve lever 522 to lift up the throttle valve lever 522. The cam surface 552*b* defines at least in part an actuator associated with the start shaft.

As shown in FIGS. 46 to 50, an elongated through hole 554 extending in an axial direction of the start shaft 532 is provided on the lid plate 521 adjacent to a contact point Q (FIG. 49) between the lid plate 521 and the peripheral surface of the start shaft 532.

Figure 50:
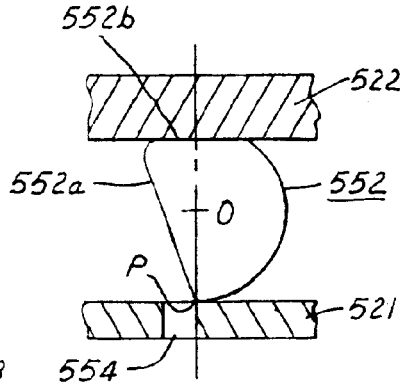
FIG. 50 is a fragmentary side sectional view showing a part of the starting device of the rotary throttle valve-type carburetor of FIG. 46.

In starting the engine, when the start lever 531 and start shaft 532 are rotated to their second position (generally in the direction of the arrow "x" in FIG. 49) the cam surface 552*b* on the end of the start shaft 532 comes in contact with the lower surface of the throttle valve lever 522, as shown in FIG. 50, to lift up the throttle valve. The needle 503 suspended from the upper portion of the throttle valve 501 moves upward to increase the open area or flow area of the fuel nozzle 504*a* of the fuel supply pipe 504 to increase the amount of fuel supplied to the engine.

When the throttle valve lever 522 is rotated toward its wide open position (in a direction indicated generally by arrow "y" of FIG. 48) after the engine is warmed-up, the cam surface 552*b* on the end of the start shaft 532 is disengaged from the throttle valve lever 522, and the start lever 531 is returned to its first position by the force of the spring 533. At this time, as shown in FIG. 50, a corner portion P, where the peripheral surface of the start shaft 532 meets the flat surface 552*a*, passes the through-hole 554, and dust, oil or other contaminants are scraped off the lid plate 521 into the through-hole 554. Accordingly, contaminants are removed from this area so that the returning of the start shaft 532 from its second position to its first position is not impaired.

What is claimed is:

1. A carburetor, comprising:

a body having an air intake passage, and a throttle valve chamber communicated with the air intake passage;

a rotary throttle valve slidably and rotatably received in the throttle valve chamber between idle and wide open positions to control the delivery of a fuel and air mixture to the engine, and having a valve shaft, a hole through the valve shaft to control the flow of air from the carburetor, and an air passage formed at least in part in the valve shaft that is in communication with the air intake passage during at least a portion of the throttle valve movement away from its idle position;

a fuel nozzle carried by the body and through which fuel flows prior to being discharged from the carburetor;

a needle carried by the throttle valve for reciprocation relative to the fuel nozzle to change the effective flow area of the fuel nozzle and thereby control the delivery of fuel from the carburetor;

a start shaft carried by the carburetor body for movement between first and second positions; and a cam operably associated with the start shaft and adapted to axially move the throttle valve away from its idle position to move the needle relative to the fuel nozzle and increase the effective flow area of the fuel nozzle permitting an increased fuel flow through the nozzle whereby the movement of the throttle valve when the start shaft is rotated to its second position communicates the air passage of the throttle valve with the air intake passage to permit increased air flow through the carburetor.

2. The carburetor of claim 1 wherein the air passage is defined at least in part by a groove formed in the valve shaft.

3. The carburetor of claim 2 wherein the groove is formed at least in part in the bottom of the valve shaft.

4. The carburetor of claim 2 wherein the groove is a split-groove formed at the lower end of the throttle valve.

5. The carburetor of claim 2 wherein the groove is disposed so that it does not communicate with the air intake passage when the throttle valve is in its idle position, and the groove communicates with the air intake position when the throttle valve is moved a predetermined distance from its idle position.

6. The carburetor of claim 1 wherein the air passage is defined by a bore formed in the valve shaft.

7. The carburetor of claim 6 wherein the bore communicates at one end with the hole in the throttle valve shaft and at its other end with the peripheral surface of the valve shaft.

8. The carburetor of claim 6 wherein the bore is disposed so that it does not communicate with the air intake passage when the throttle valve is in its idle position, and the bore communicates with the air intake position when the throttle valve is moved a predetermined distance from its idle position.

9. A carburetor, comprising:

a body having an air intake passage, a throttle valve chamber communicated with the air intake passage, and an opening;

a rotary throttle valve slidably and rotatably received in the throttle valve chamber between idle and wide open positions to control the delivery of a fuel and air mixture to the engine, and having a valve shaft, and a hole through the valve shaft to control the flow of air from the carburetor, a fuel nozzle carried by the body and through which fuel flows prior to being discharged from the carburetor;

a needle carried by the throttle valve for reciprocation relative to the fuel nozzle to change the effective flow area of the fuel nozzle and thereby control the delivery of fuel from the carburetor;

a start shaft carried by the body adjacent at least in part to the opening and movable between first and second positions, the movement of the start shaft causing at least a portion of the start shaft to pass near the opening to communicate contaminants in the area of the start shaft with the opening; and a cam operably associated with the start shaft and adapted to axially move the throttle valve away from its idle position to move the needle relative to the fuel nozzle and increase the effective flow area of the fuel nozzle permitting an increased fuel flow through the nozzle.

10. The carburetor of claim 9 wherein the body has a lid plate through which a portion of the throttle valve extends and adjacent to which the start shaft is carried, and wherein the opening is formed in the lid plate.

11. The carburetor of claim 9 wherein the cam is formed on the start shaft and a corner portion is defined between the cam and the adjacent peripheral surface of the start shaft, the corner portion passing the hole in the body during at least a portion of the movement of the start shaft between its first and second positions.

12. The carburetor of claim 11 wherein the body has a lid plate through which a portion of the throttle valve extends and adjacent to which the start shaft is carried, and wherein the opening is formed in the lid plate.

* * * * *